US006213587B1

(12) United States Patent
Whitman

(10) Patent No.: US 6,213,587 B1
(45) Date of Patent: Apr. 10, 2001

(54) INK JET PRINTHEAD HAVING IMPROVED RELIABILITY

(75) Inventor: Charles S. Whitman, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/356,573

(22) Filed: Jul. 19, 1999

(51) Int. Cl.[7] ..... B41J 2/14; B41J 2/05
(52) U.S. Cl. ..... 347/47; 347/63; 347/65
(58) Field of Search ..... 347/65, 62, 47, 347/63, 57, 56, 519

(56) References Cited

U.S. PATENT DOCUMENTS

| | | | |
|---|---|---|---|
| 4,296,309 | 10/1981 | Shinmi et al. | 347/204 |
| 4,638,337 | 1/1987 | Torpey et al. | 347/65 |
| 4,672,392 | 6/1987 | Higeta et al. | 347/202 |
| 4,870,433 | 9/1989 | Campbell et al. | 347/62 |
| 4,907,015 | 3/1990 | Kaneko et al. | 347/204 |
| 4,914,562 | 4/1990 | Abe et al. | 347/63 |
| 4,931,813 | 6/1990 | Pan et al. | 347/62 |
| 4,947,193 | 8/1990 | Deshpande | 347/62 |
| 4,951,063 | 8/1990 | Hawkins et al. | 347/62 |
| 5,066,963 | 11/1991 | Kimura et al. | 347/62 |
| 5,148,185 | 9/1992 | Abe et al. | 347/65 |
| 5,182,577 | 1/1993 | Ishinaga et al. | 347/58 |
| 5,389,954 | 2/1995 | Inaba et al. | 347/258 |
| 5,418,553 | 5/1995 | Connolly | 347/200 |
| 5,481,287 | 1/1996 | Tachihara | 347/62 |
| 5,530,467 | 6/1996 | Ishigami et al. | 347/204 |
| 5,563,642 | 10/1996 | Keefe et al. | 347/84 |
| 5,594,481 | 1/1997 | Keefe et al. | 347/65 |
| 5,604,519 | 2/1997 | Keefe et al. | 347/13 |
| 5,619,236 | 4/1997 | Keefe et al. | 347/84 |
| 5,638,101 | 6/1997 | Keefe et al. | 347/65 |
| 5,648,805 | 7/1997 | Keefe et al. | 347/65 |
| 5,661,510 | 8/1997 | Brandon et al. | 347/87 |
| 5,661,513 | 8/1997 | Shirakawa et al. | 347/202 |
| 5,719,605 | 2/1998 | Anderson et al. | 347/59 |
| 5,745,147 | 4/1998 | Johnson et al. | 347/200 |
| 5,751,324 | 5/1998 | Brandon et al. | 347/87 |
| 5,818,478 | 10/1998 | Gibson | 347/45 |
| 6,045,214 * | 4/2000 | Murthy et al. | 347/47 |

* cited by examiner

*Primary Examiner*—John Barlow
*Assistant Examiner*—Juanita Stephens
(74) *Attorney, Agent, or Firm*—John A. Brady

(57) ABSTRACT

The present invention relates to an inkjet printhead with improved reliability. The printhead comprises a transducer, a chamber, and a plate. At least a portion of the transducer is arranged within the chamber, and the plate is provided with at least one aperture capable of cooperating with the chamber to allow ink to be ejected therefrom. The plate has a thickness of less than 62 microns and the transducer can be selectively energized with a power density less than 2.159 $GW/m^2$ to cause droplets of the ink to be ejected. In one embodiment, the plate is separated from the transducer by a distance of less than 28 microns.

34 Claims, 20 Drawing Sheets

INK JET PRINTHEAD HAVING IMPROVED RELIABILITY

TECHNICAL FIELD

The present invention relates to an ink jet printhead with improved transducer life, and, more specifically, to an ink jet printhead having a reduced nozzle plate thickness, a reduced barrier height, and a reduced power density applied to the heaters of the printhead.

BACKGROUND OF THE INVENTION

Ink jet printers typically include recording heads, referred to hereinafter as printheads, that employ transducers which utilize kinetic energy to eject ink droplets. For example, thermal printheads rapidly heat thin film resistors (or heaters) to boil ink, thereby ejecting an ink droplet onto a print receiving medium, such as paper. According to this ink jet method, upon firing a resistor, a current is passed through the resistor to rapidly generate heat. The heat generated by the resistor rapidly boils or nucleates a layer of ink in contact with or in proximity to a surface of the resistor.

The nucleation causes a rapid vaporization of the ink vehicle, creating a vapor bubble in the layer of ink. The expanding vapor bubble pushes a portion of the remaining ink through an aperture or orifice in a plate, so as to deposit one or more drops of the ink on a print receiving medium, such as a sheet of paper. The properly sequenced ejection of ink from each orifice causes characters or other images to be printed upon the print receiving medium as the printhead is moved relative to the print receiving medium.

Typically, the orifices provided on such a plate are arranged in one or more linear arrays. Moreover, the paper is typically shifted each time the printhead moves across the paper. The thermal ink jet printer is generally fast and quiet, as only the ink droplet is in contact with the paper. Such printers produce high quality printing and can be made both compact and economical.

In general, the reliability of a printhead can be dependent on the reliability of the energy-generating elements or transducers it utilizes. Accordingly, and as can be understood, increasing the expected lifespan of the transducers would improve the reliability of the printheads in which they are used. Thus, it would be advantageous to have a printhead that has increased transducer life.

SUMMARY OF THE INVENTION

Accordingly, it is an object of the present invention to improve the reliability of inkjet printheads.

It is another object of the present invention to provide an inkjet printhead including a transducer having an increased life span.

According to one embodiment of the present invention, an inkjet printhead comprises a transducer (such as a heater resistor), a chamber, and a plate. At least a portion of the transducer is arranged within the chamber, and the plate is provided with at least one aperture capable of cooperating with the chamber to allow ink to be ejected therefrom. The plate has a thickness of less than 62 microns and the transducer can be selectively energized with a power density less than 2.159 $GW/m^2$ to cause droplets of the ink to be ejected.

Preferably, the plate is separated from the transducer by a distance of less than 28 microns. More preferably, the plate is so separated by about 8 to about 27 microns. In preferred inkjet printheads according to this embodiment, the transducer comprises a heater having a heater area of less than about 2800 $microns^2$, and/or the inkjet printhead comprises a mono ink.

According to another preferred embodiment of the present invention, the plate thickness is less than about 60 microns and, more preferably, is about 35 to about 55 microns. In a further preferred embodiment, the transducer is capable of being selectively energized with a power density less than about 2 $GW/m^2$ to cause droplets of ink to be ejected from the chamber. With mono-ink printheads, this transducer is capable of being selectively energized with a power density preferably less than about 1.3 $GW/m^2$ to cause droplets of ink to be ejected from the chamber and, more preferably, from about 0.7 to about 1 $GW/m^2$. Meanwhile, with multi-color ink printheads, this transducer is capable of being selectively energized with a power density preferably from about 0.7 to about 1.5 $GW/m^2$.

In a preferred embodiment, the printhead comprises a mono ink. This embodiment can be particularly preferred when utilizing a transducer capable of being selectively energized with a power density greater than 1 $GW/M^2$ to cause droplets of ink to be ejected from the chamber or when the plate is separated from the transducer by a distance of less than 28 microns. When using mono ink and a heater as a transducer, the heater area is preferably greater than about 1900 $microns^2$.

According to an alternative embodiment, the printhead comprises a multi-color non-phosphate ink. This alternative can be particularly preferred when utilizing a transducer capable of being selectively energized with a power density less than 2 $GW/r^2$ to cause droplets of ink to be ejected from the chamber or when the plate thickness is greater than 40 microns. As with mono ink, when using a multi-color non-phosphate ink and a heater as a transducer, the heater area is preferably greater than about 1900 $microns^2$. By comparison, when using an ink containing phosphates and a heater as a transducer, the heater area is preferably less than about 2800 $microns^2$.

In another embodiment of the present invention, an inkjet printhead comprises a plurality of transducers and chambers, with at least a portion of each transducer being arranged within a respective chamber. A plate having a plurality of apertures is also provided. Each aperture cooperates with a respective chamber to allow ink to be ejected therefrom.

According to this embodiment of the present invention, the plate has a thickness of less than 62 microns. Moreover, each transducer can be selectively energized with a power density less than 2.159 $GW/m^2$ to cause the ejection of the ink. Preferably, the plate is separated from the transducer by a distance of less than 28 microns.

In yet another embodiment of the present invention, an inkjet printer comprises a printhead and power source. The printhead includes a transducer, a chamber, and a plate. At least a portion of the transducer is arranged within the chamber.

The plate is provided with at least one aperture capable of cooperating with the chamber to allow ink to be ejected therefrom. The plate also has a thickness of less than 62 microns. In addition, the power source is capable of selectively energizing the transducer with a power density less than 2.159 $GW/m^2$ to cause the ejection of the ink from the chamber. In a preferred form, the plate can be separated from the transducer by a distance of less than 28 microns.

Still other aspects of the present invention will become apparent to those skilled in this art from the following description wherein there is shown and described various embodiments of this invention, simply by way of illustration. As will be realized, the invention is capable of other different aspects and embodiments without departing from the scope of the invention. Accordingly, the drawings and descriptions should be regarded as illustrative in nature and not as restrictive in nature.

BRIEF DESCRIPTION OF THE DRAWINGS

While the specification concludes with claims particularly pointing out and distinctly claiming the invention, it is believed the same will be better understood from the following description taken in connection with the accompanying drawings in which:

DETAILED DESCRIPTION OF THE PREFERRED EMBODIMENTS.

Figure 1:
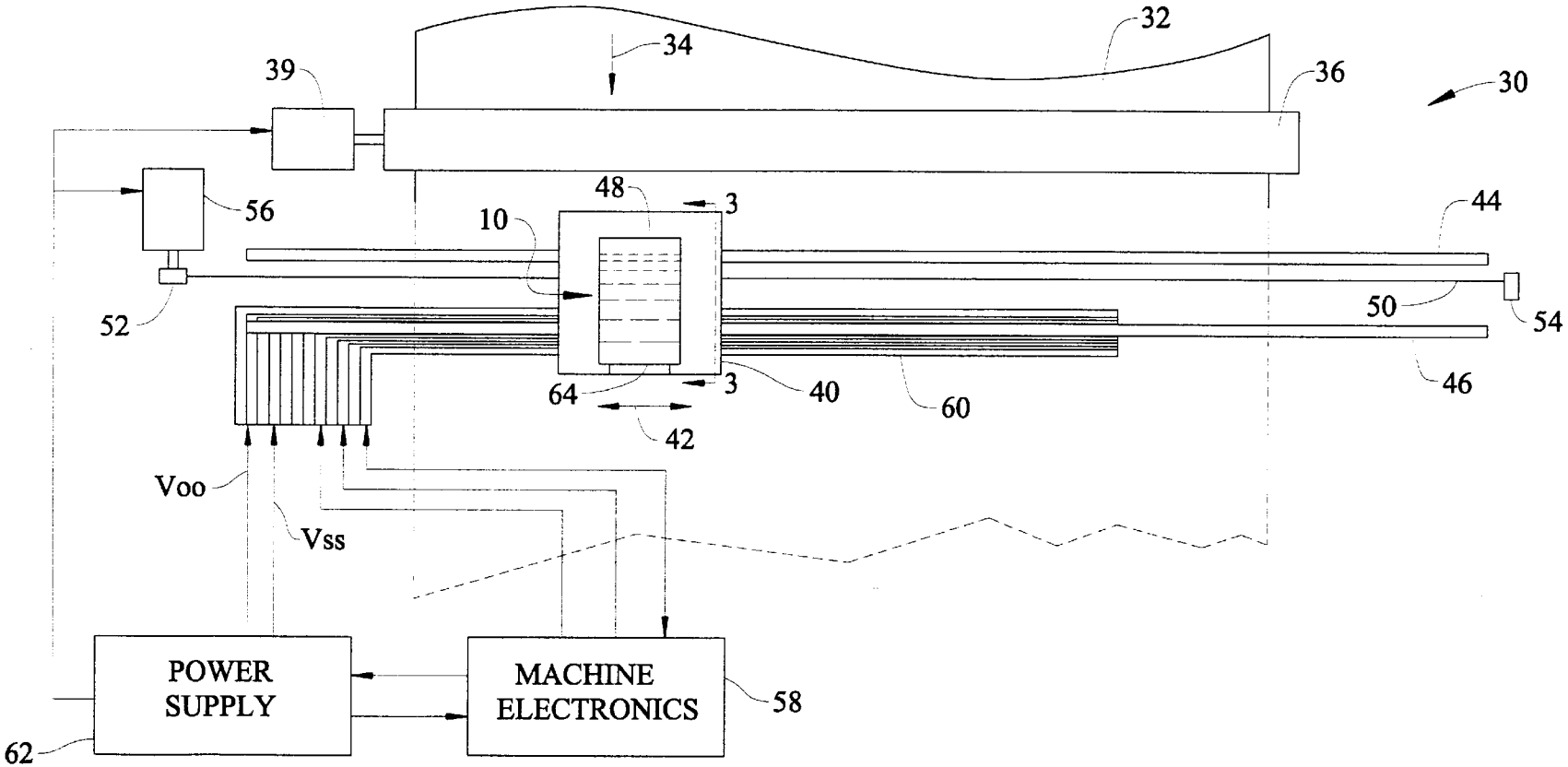
FIG. 1 is a schematic plan view of a thermal ink jet printer for receiving a printhead to which the novel method and apparatus of the present invention pertains.

Referring now to the drawings in detail, wherein like numerals indicate the same elements throughout the views, FIG. 1 illustrates an embodiment of an ink jet printer 30 to which the present invention can be applicable. A print receiving medium 32, which can be a recording medium made from paper, thin film plastic or the like, can be moved in the direction of an arrow 34, being guided by superimposed pairs 36, 38 of sheet feed rollers and under the control of a medium drive mechanism, such as a drive motor 39, for example.

Figure 2:
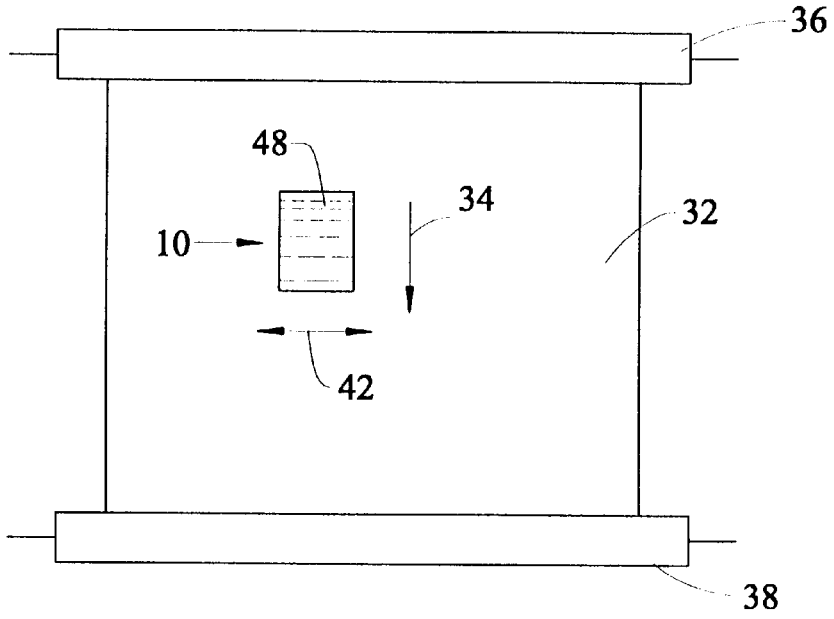
FIG. 2 is a schematic and fragmentary view of a portion of the apparatus illustrated in FIG. 1, showing printhead and print receiving medium relative motion.

As shown in FIGS. 1 and 2, a printhead 10 can be mounted on a carrier 40, which can be carried in close proximity to a print receiving medium 32, which in turn can be transported by roller pairs 36, 38. As shown by the arrow 42, the printhead 10 (and thus the printhead carrier 40) can be mounted for orthogonal, reciprocatory motion relative to the print receiving medium 32. To this end, and as shown in FIG. 1, the carrier 40 can be mounted for reciprocation along a pair of guide shafts 44 and 46.

The reciprocatory or side-to-side motion of the carrier 40 can be established by a carrier drive, such as one having a transmission mechanism including a cable or drive belt 50 and pulleys 52, 54 which carry the belt 50 driven by a motor 56. In this manner, the printhead 10 may be moved and positioned at designated positions along a path defined by and under the control of the carrier drive and machine electronics 58. The carrier 40 and the printhead 10 are connected electrically by a flexible printed circuit cable 60 for supplying power from the power supply 62 to printhead 10, and to supply control and data signals to printhead 10 from the machine electronics 58, which includes the printer control logic (PCL).

Figure 3:
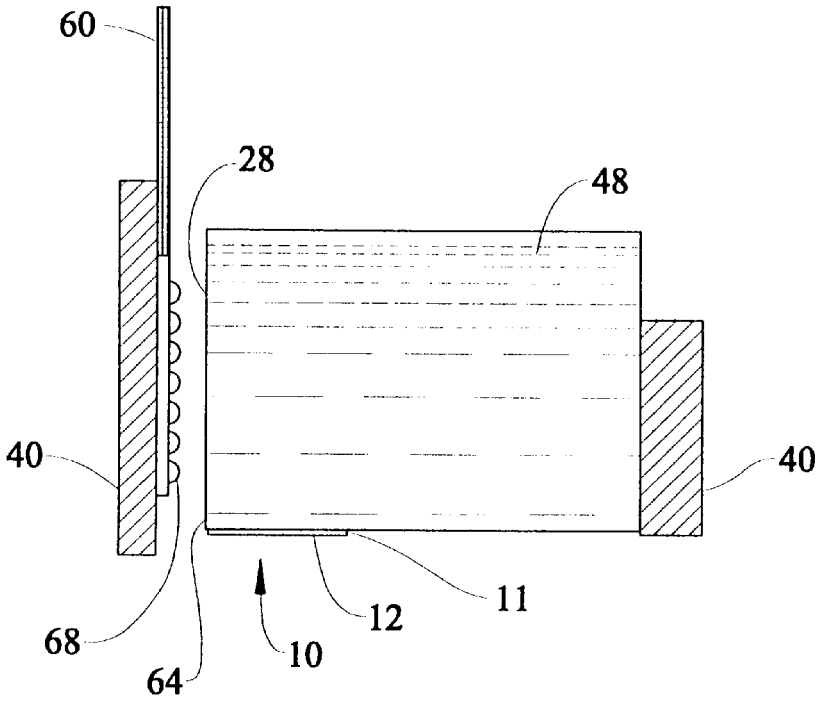
FIG. 3 is an enlarged, partially exploded, fragmentary cross-sectional view of a portion of the apparatus shown in FIG. 1, taken along line 3—3 of FIG. 1.

According to one embodiment of the present invention, printhead 10 includes a printhead chip 11 attached, preferably by way of an adhesive bond, to a plate 12 having a plurality of individually selectable and actuable nozzle orifices or apertures 22. The printhead 10 can also include a supply of ink in, for example, an ink-holding reservoir 48, such as a tank or bottle. As illustrated in FIG. 3, the nozzle plate 12 and chip 11 can be bonded to the reservoir 48.

Chip 11 can be one of many cut from, in a conventional manner, a silicon wafer which, for example, has been coated with photoresist, photolithographically exposed through a mask, subjected to an etch bath and doped by processes well known in the art of semiconductor manufacturing. This process can be repeated through several layers, including metalization for interconnects 70. Usually, multiple integrated circuit chips 11 are made on a single wafer, which is then cut or diced, into individual chips, or dies.

Figure 4:
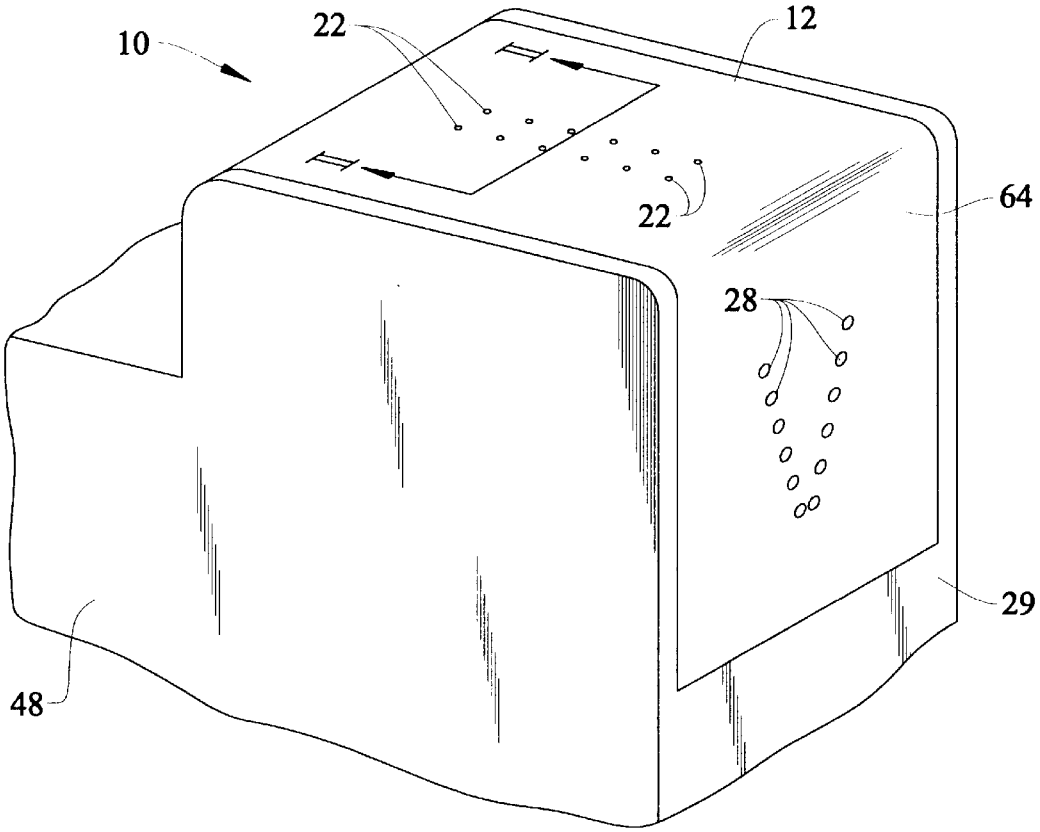
FIG. 4 is a partial perspective view of an ink jet printhead.

As shown in FIG. 4, the input and output of the chip 11, including control signals and power, can be applied through a TAB (tape automated bonding) circuit 64 and spaced apart integrated beams or lands (not shown) therein for making input and output (including electrical) connection to the chip, preferably at interconnects 70. The TAB circuit 64 typically surrounds the chip 11 and can be fastened to a circuit platform (not shown) on the reservoir 48 using a pressure sensitive adhesive, also known as a pre-form adhesive. After the printhead chip 11 is placed on the circuit platform and the TAB circuit 64 is attached to the interconnects 70, an ultraviolet (UV) photosensitive adhesive can be applied along the sides of the chip and over the beams, as an encapsulant and protectant. A light source can then be applied to the UV adhesive to cure the same.

In the illustrated instance, the tape 64 extends along one surface 29 of the reservoir 48, with electrical contact or terminal pads 28 therein for mating engagement with terminal protrusions or projections 68 on the flexible printed circuit cable 60. For ease of illustration and understanding, the portion of the carrier 40 carrying the flexible printed circuit cable 60 and its protruding electrical connections 68 is shown in FIG. 3 as being spaced from the pads 28 of the TAB circuit or tape 64. Upon insertion of the printhead 10 into the carrier 40, however, electrical mating engagement occurs between the pads 28 of tape 64 and the protrusions or projections 68 of the flexible printed circuit cable 60. There are numerous techniques for engagement between the contacts 68 and the pads 28, including sliding frictional engagement, and any such technique is acceptable as long as static discharge between the two connections is minimized or avoided during mating engagement or interconnection.

Figure 5:
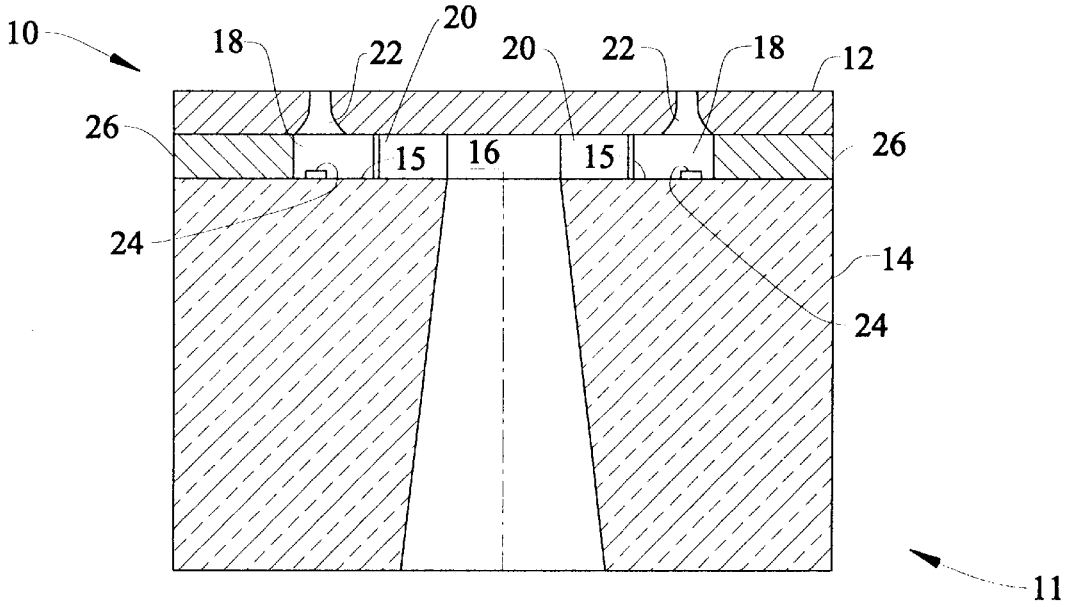
FIG. 5 is an enlarged cross-sectional detail of an ink jet printhead.

As depicted in FIG. 5, a printhead 10 comprises at least one energy-generating element or transducer, such as an electro-thermal converting element (e.g., a heater 24). In a preferred form, the transducer comprises a thin film resistor formed on the chip 11. The thin film resistor (referred to hereinafter as a heater) can generate thermal energy by applying a voltage difference across electrodes (not shown) connected to the resistive material.

Figure 6:
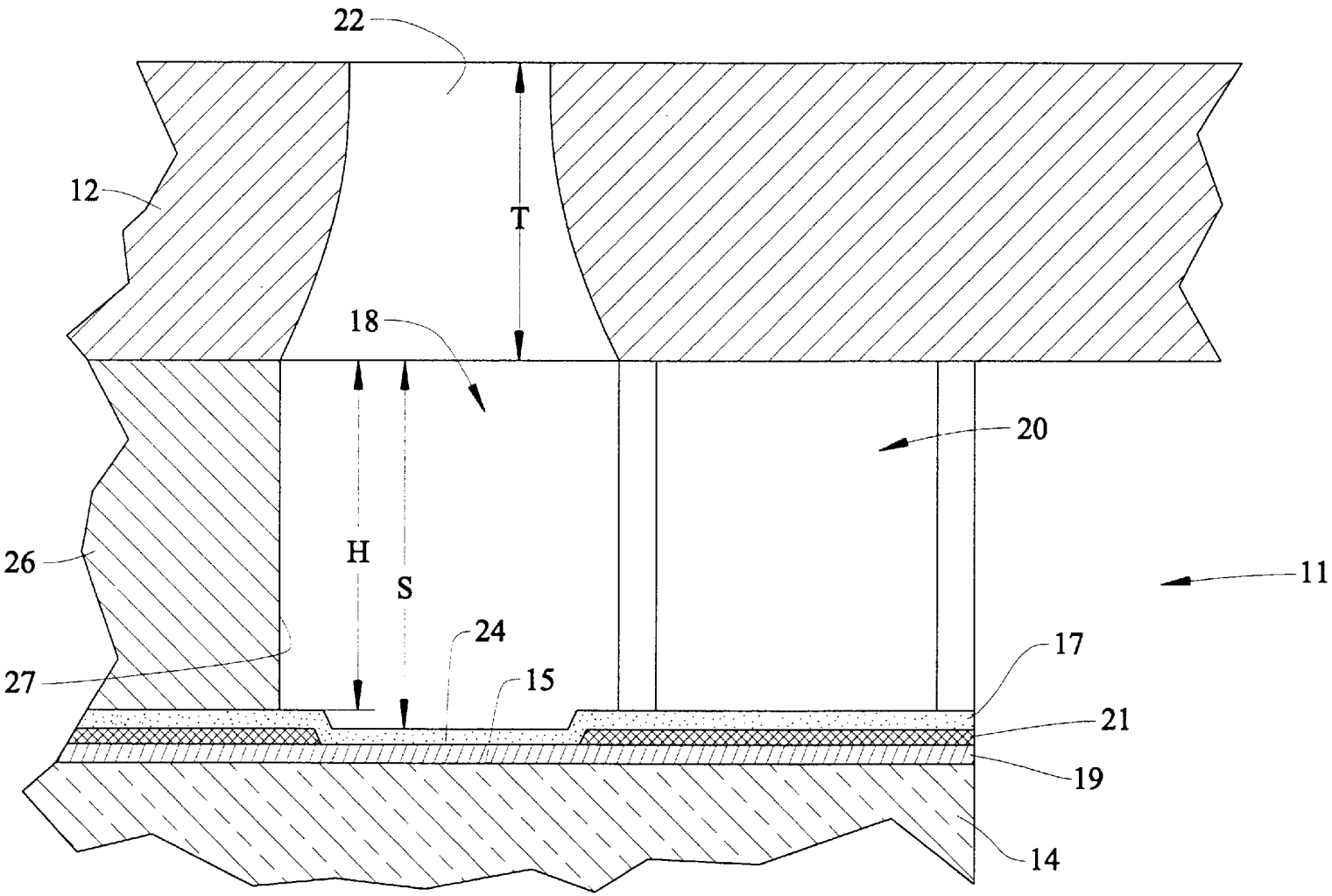
FIG. 6 is a selectively sectioned cross-sectional detail of an ink jet printhead.
Figure 6A:
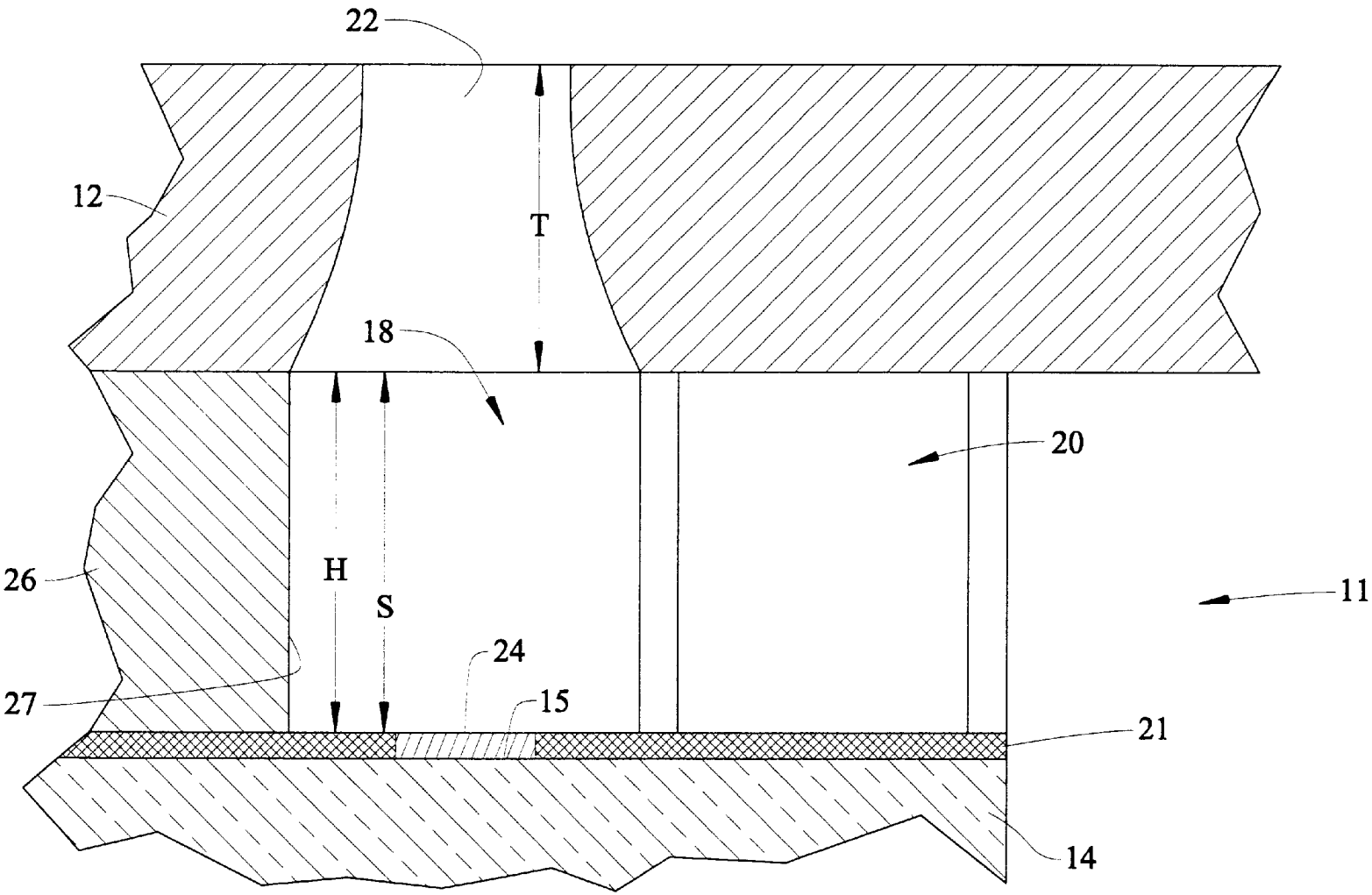
FIGS. 6A through 6E are selectively sectioned cross-sectional details of alternative ink jet printheads according to the present invention.

Referring to FIG. 6, according to a preferred embodiment of the present invention, the heater 24 can be formed from a resistance layer 19 that is deposited on a surface 15 of a substrate base 14. Preferably, a thermal barrier (not shown) is provided between the resistance layer 19 and the surface 15 of the base 14. Although the resistance layer can comprise materials such as tantalum oxide (TaO) or hafnium diboride ($HfB_2$), it preferably comprises tantalum aluminum (TaAl). Meanwhile, the substrate 14 can comprise materials such as quartz and glass, but preferably comprises silicon.

A conductive layer 21, preferably comprising an aluminum-copper alloy (AlCu), can be formed over or under the resistance layer 19. Conventionally, the conductive layer 21 is approximately 0.5 microns thick. Portions of the respective upper layer can be removed by techniques known in the art, such as chemical etching. With the selected portions removed, the remaining portions of the conductive layer 21 form electrodes and the remaining portion of the resistance layer 19 forms the heater 24.

The printhead 10 also has an ink supply labyrinth comprising, for example, an ink vaporization chamber 18. According to a preferred embodiment of the present invention, the ink supply labyrinth can be preferably formed between the chip 11 and the plate 12, and also comprises a channel 16 and a conduit lateral 20 for connecting the channel 16 and the chamber 18. The channel 16 (also referred to as a via) can be preferably disposed through the base 14 of the chip 11 and allows ink to pass from the ink reservoir 48 (typically behind the chip) into the conduit lateral 20 and into chamber 18. According to a preferred form of the present invention, the channel 16 can be cut into the base 14 by means of grit blasting or laser cutting, or can exist between an edge of the chip 11 and the ink reservoir 48.

Figure 7:
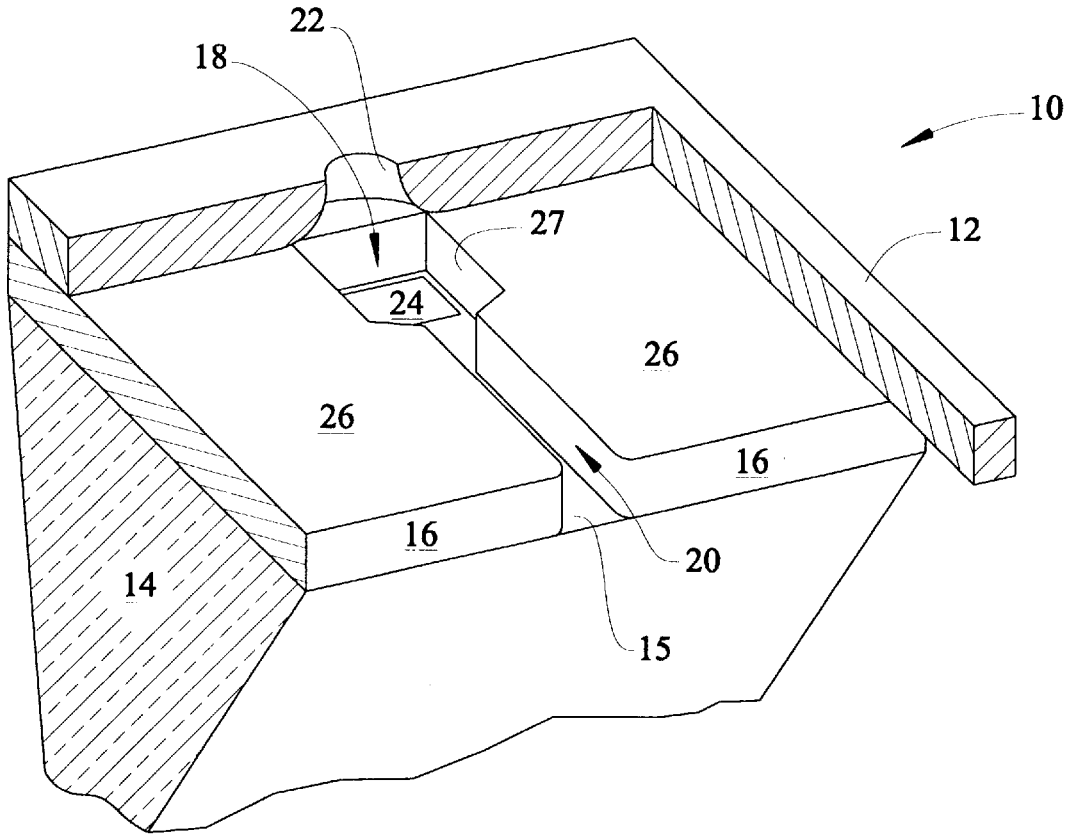
FIG. 7 is a selectively sectioned perspective view of the ink jet printhead of FIG. 5.
Figure 8:
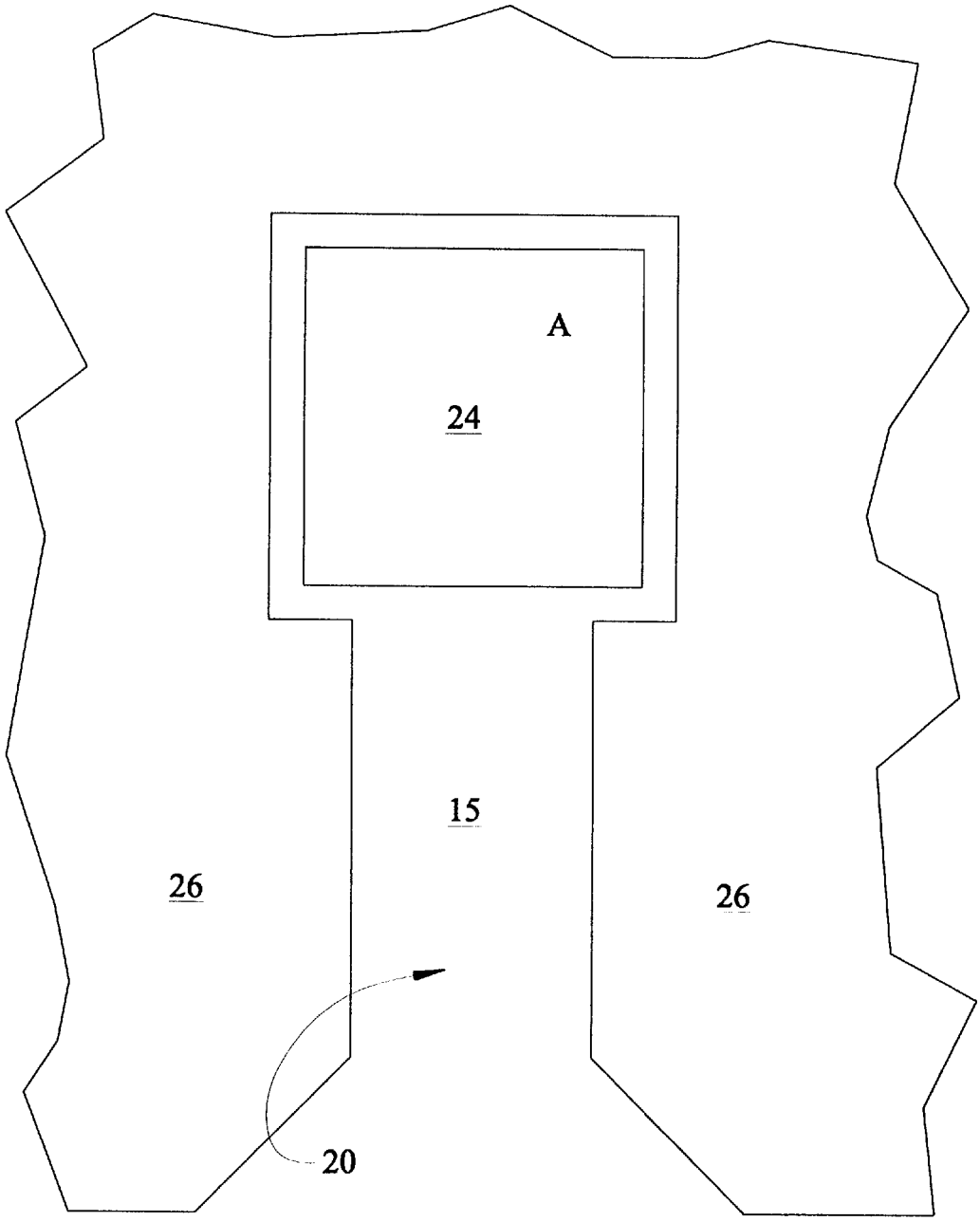
FIG. 8 is a top view of the selectively sectioned perspective view shown in FIG. 7.

As illustrated in FIGS. 6–8, at least a portion of the heater 24 is arranged within the chamber 18. For example, a surface area (A) of the heater 24 can be arranged within the chamber 18. Although the various figures illustrate a preferred embodiment wherein the entire heater 24 is arranged within the chamber 18, the heater could also be only partially arranged within the chamber.

The chamber 18 has a wall or barrier 27 that extends for a height (H) above the heater 24, including any layers over the heater, such as a protective layer 17 (e.g., passivation or anti-cavitation layer), for example. As with the conductive layer 21, a layer such as protective layer 17 is conventionally also approximately 0.5 microns thick. The barrier 27 can be operative to help separate the heater 24 a separation distance (S) from the nozzle plate 12, also including any layers over the heater, and can serve to define a part of the ink labyrinth.

Figure 6B:
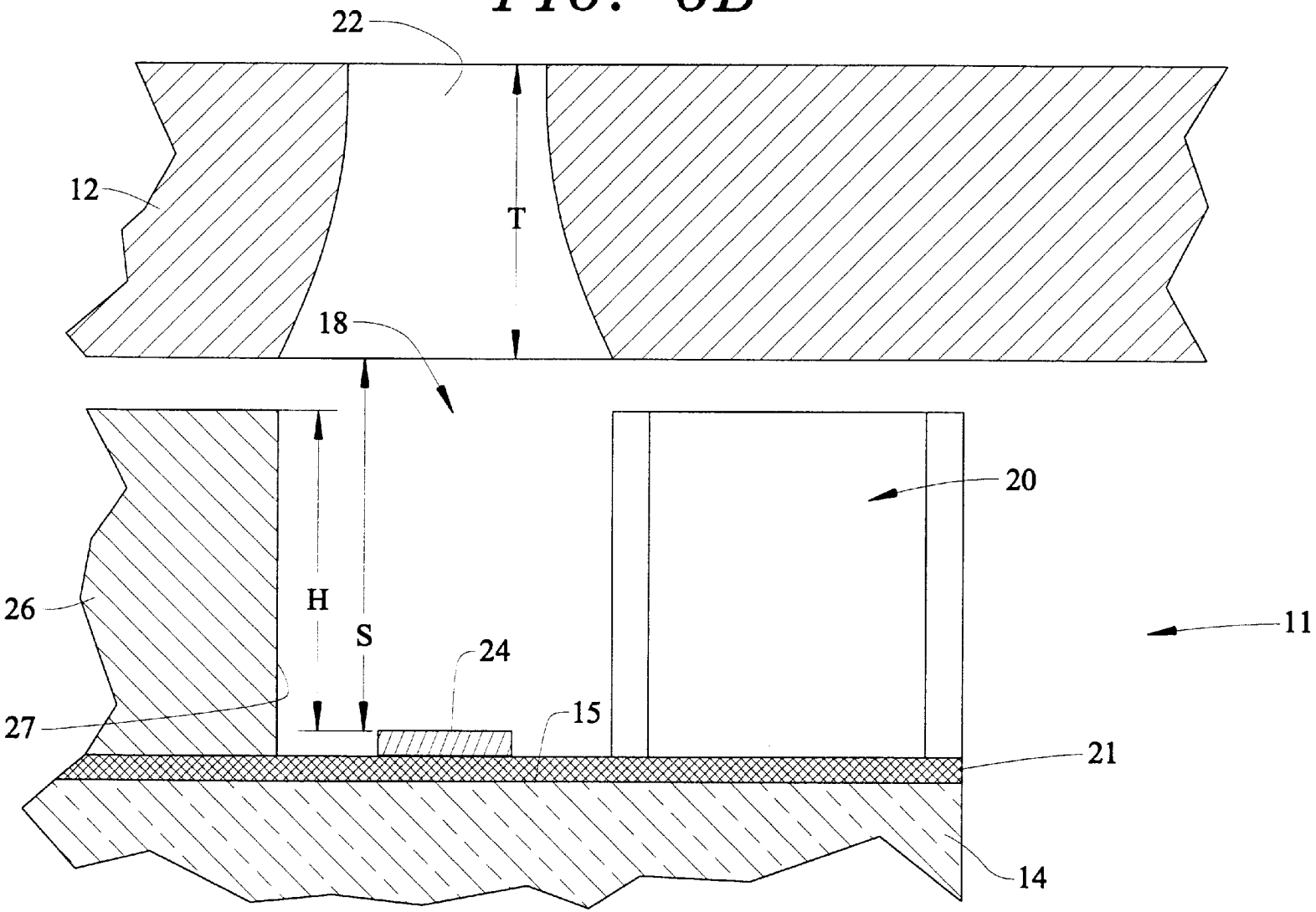
Figure 6C:
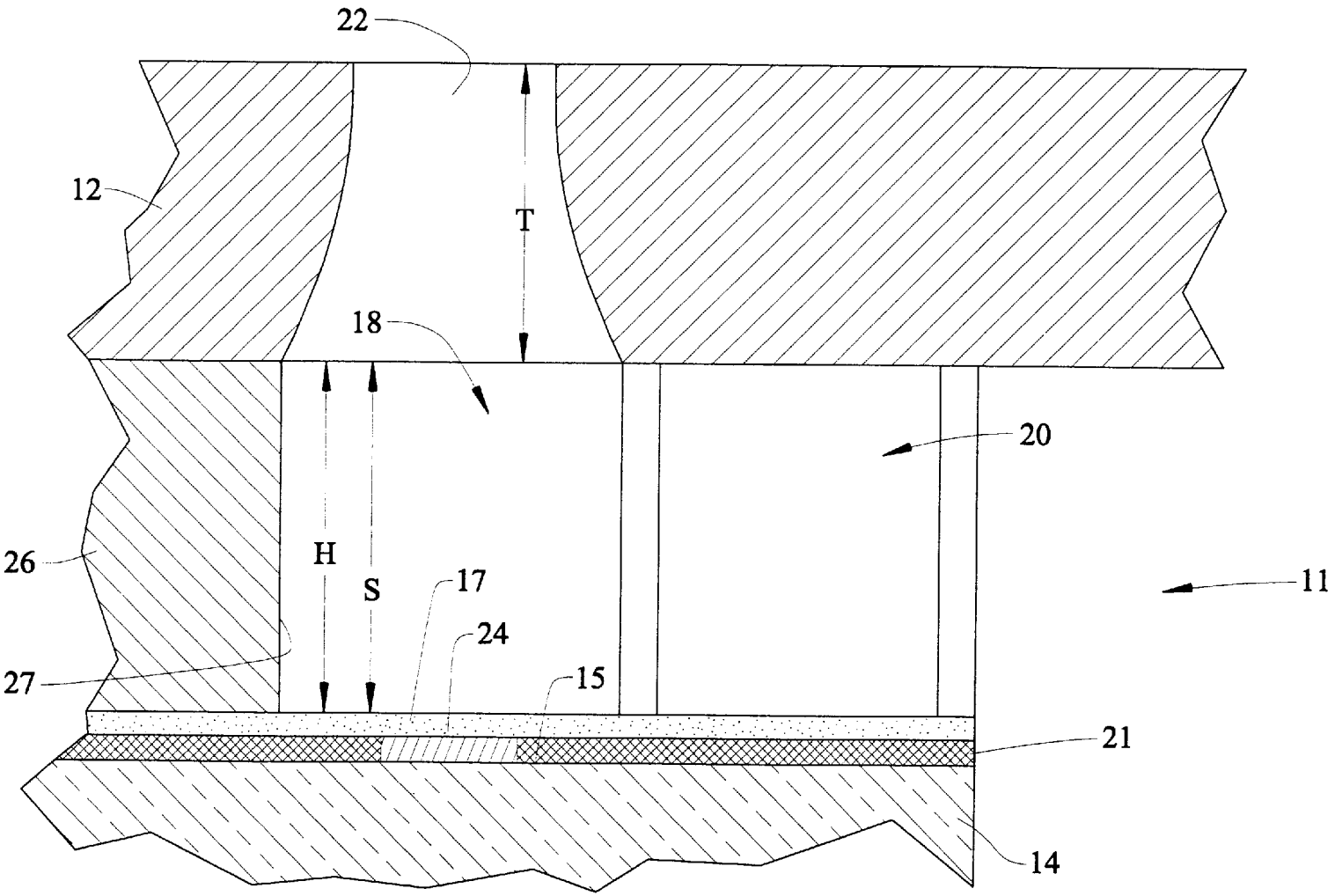
Figure 6D:
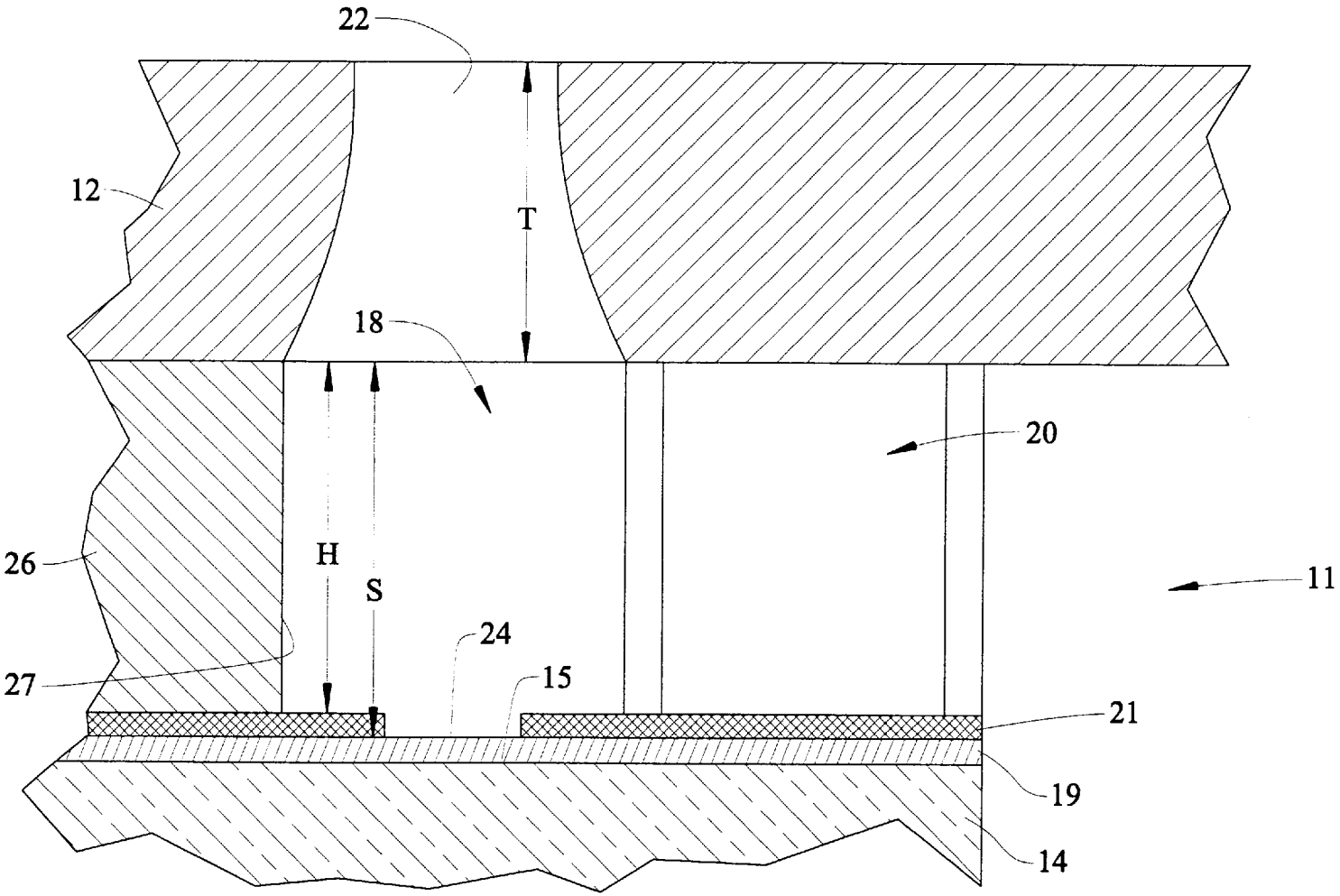
Figure 6E:
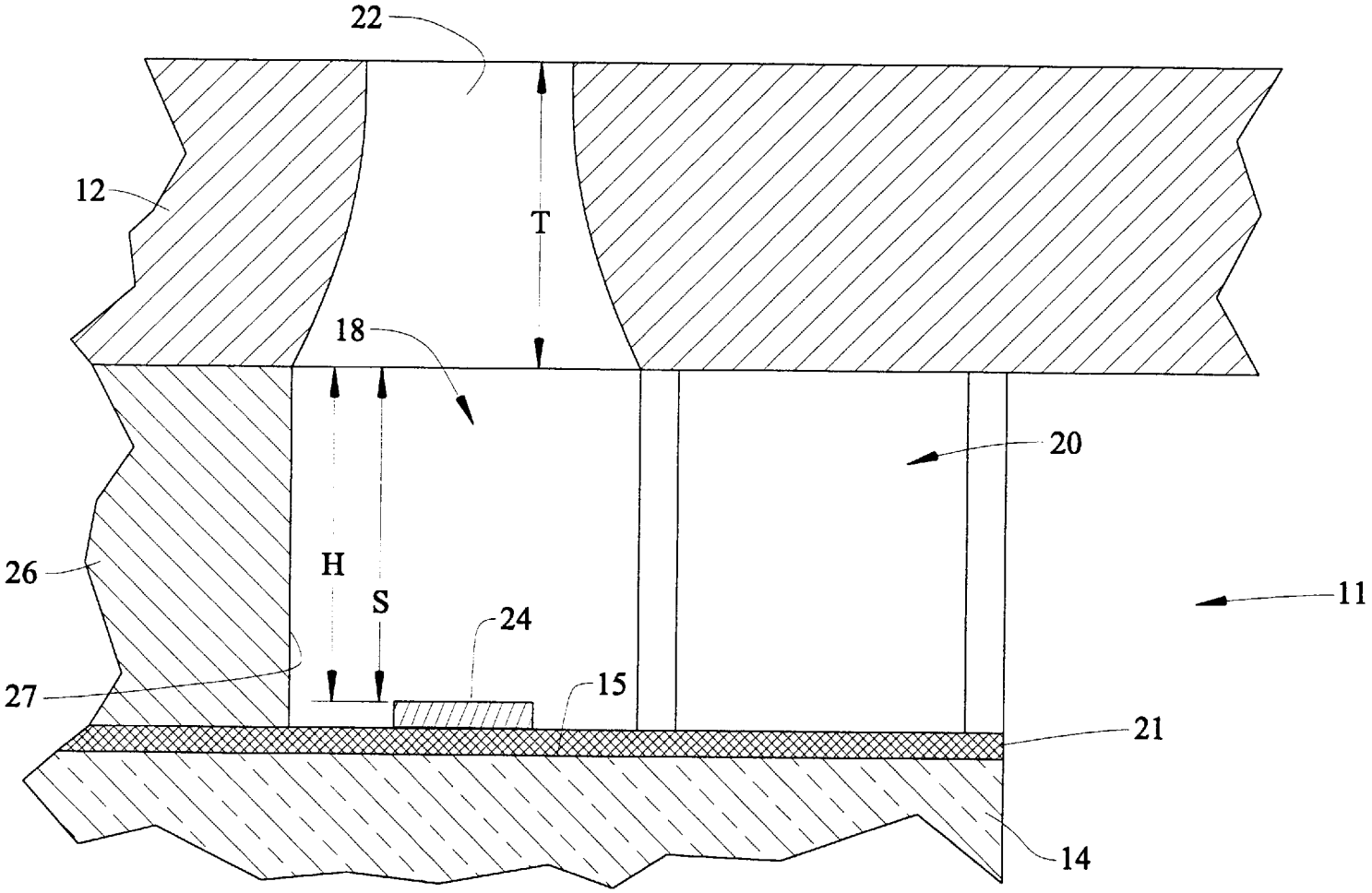

Although the barrier 27 is shown in the illustrated embodiments as being an integral wall that generally rises from the surface 15 of the base 14 to the nozzle plate 12, the present invention is also directed towards embodiments where the barrier 27 may not be integral, such as where it may include apertures for example, as well as towards embodiments where the barrier does not generally rise from the surface of the base and/or rise to the nozzle plate. For example, although FIGS. 6A and 6C–6E illustrate alternate embodiments where the barrier height (H) is substantially equal to the nozzle plate separation distance (S) (given the tolerances associated with the barrier 27 and the relative thickness of any existing layers, such as protective layer 17 and/or conductive layer 21, for example), the barrier height (H) need not necessarily be equal to the separation distance (S), as depicted in FIG. 6B. For simplification, however, barrier height (H) and nozzle plate separation distance (S) will hereinafter be assumed to be substantially equal.

Preferably, the chamber 18 can be formed in a thick spacer or insulating film 26, referred to hereinafter as the thick film layer. Although the thick film layer 26 can comprise a number of materials, such as dry resist, spun-on, or wet process type films, it preferably comprises a photo-developable polymer, such as the dry film resist marketed by Tokyo Ohka Kogyo of Kawasaki, Japan as Ordyl. Typically, the thick film layer 26 is deposited over the resistance layer (and any additional layers such as protective layer 17 and conductive layer 21) on a printhead chip 11. Conventionally, the thickness of the thick film layer 26 can be determined within a tolerance range of 10%. The chamber 18 can be formed, for example, by chemically etching away at least a portion of the thick film layer 26, as is also known in the art.

A plate 12 having a thickness (T) and provided with at least one aperture 22, cooperates with the chamber 18 to allow the heater 24 to eject ink from the chamber through the aperture 22. Although the plate 12 can, for example, be integral with the reservoir 48, it is preferably separable to allow for the attachment of a chip 11. Likewise, in an alternative embodiment, the plate 12 could also be formed from TAB circuit 64 or the like.

According to one embodiment, a separable plate can be attached to the thick film layer 26 throught the application of heat and compression. An adhesive can also be used in this process. Conventionally, the use of heat and compression reduces the height of the thick film layer 26 by approximately 2 microns.

The aperture 22, also referred to as an ink ejection orifice or nozzle, in the plate 12 of the printhead 10 confronts the print receiving medium 32. Accordingly, ink may be ejected by applying kinetic energy to the ink in the chamber 18 to effect printing on the print receiving medium 32. In operation, the ink can flow from the channel 16, into the channel 20, into the chamber 18, and out through the nozzle 22. It should be noted that the nozzles 22 shown in the figures are not to scale, and while a plurality are shown, the number is only by way of example.

The plate 12 (referred to hereinafter as the nozzle plate) can preferably be made of stainless steel (sometimes coated on opposite sides with gold and/or tantalum for attachment to the thick film 26) or a hard, thin and high wear-resistant polymer layer. Alternatively, the chamber 18 and nozzle 22 can be created from, for example, a single polymer material, as is known in the art. Such a polymer nozzle plate 12 might include, for example, slots or openings to expose interconnects 70.

According to a preferred embodiment of the present invention, the printhead 10 comprises a plurality of heaters 24. Although the plurality of heaters 24 can be arranged within one chamber 18, and portions of an individual heater can be arranged within a plurality of chambers, each of the heaters is preferably arranged in a respective one of a plurality of chambers. One advantage of arranging each heater 24 in a respective chamber 18 is that this tends to reduce "cross talk" between the heaters, as can be understood by one of ordinary skill in the art.

Figure 9:
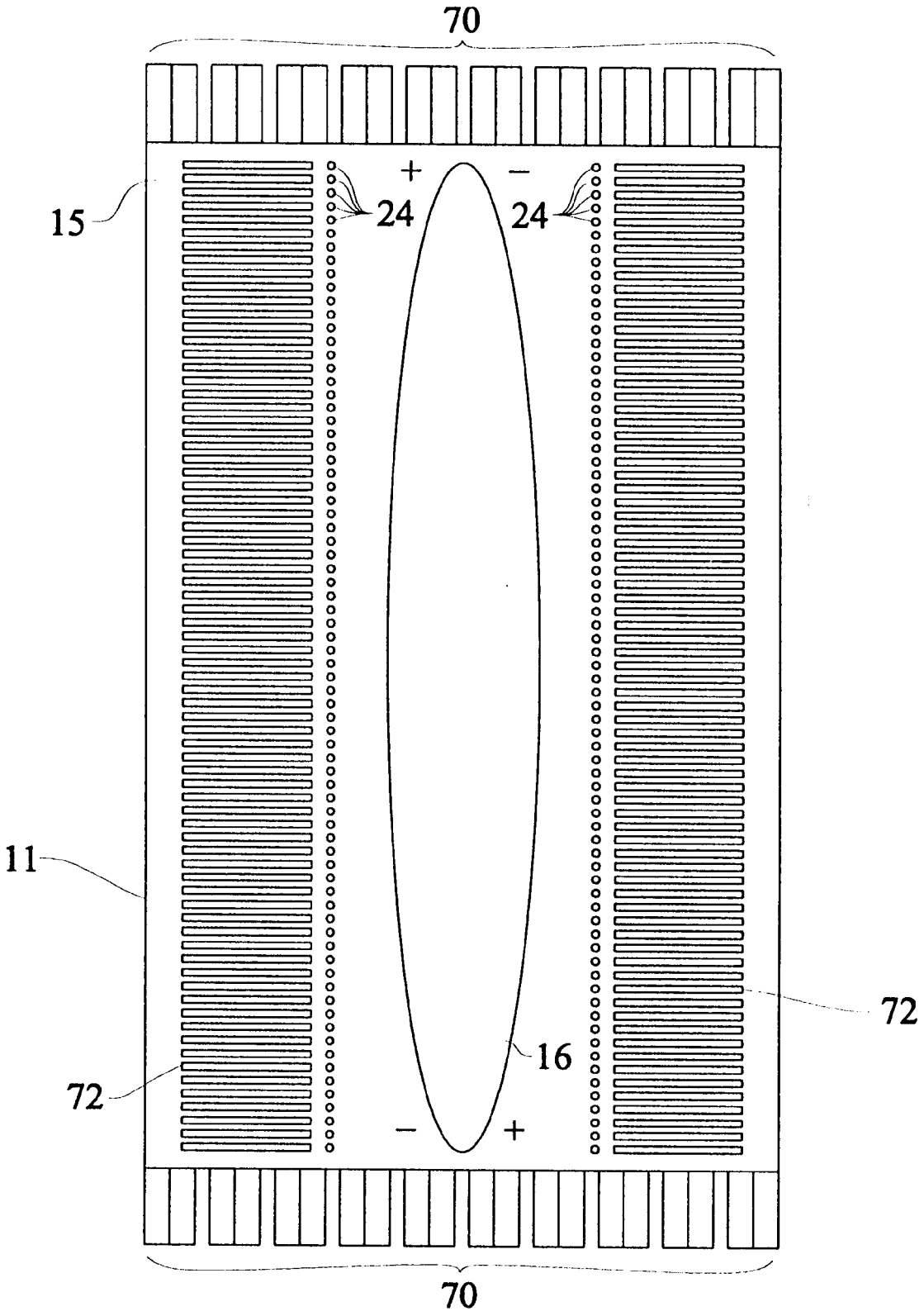
FIG. 9 is an enlarged schematic view in plan of a printhead chip showing the relative positions of electrical components positioned thereon.
Figure 10:
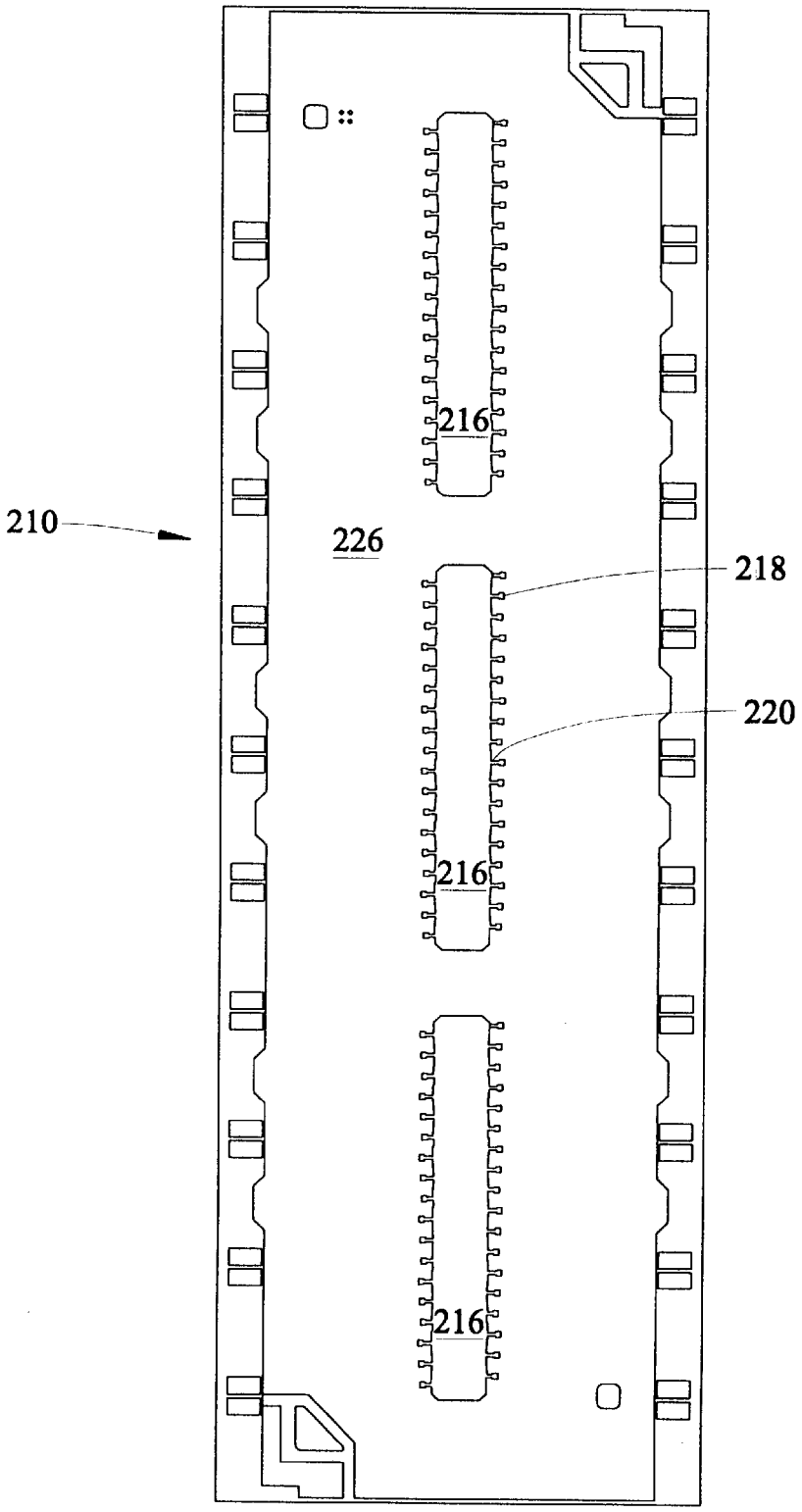
FIG. 10 is a top view of a multi-color printhead chip according to one embodiment of the present invention.
Figure 11:
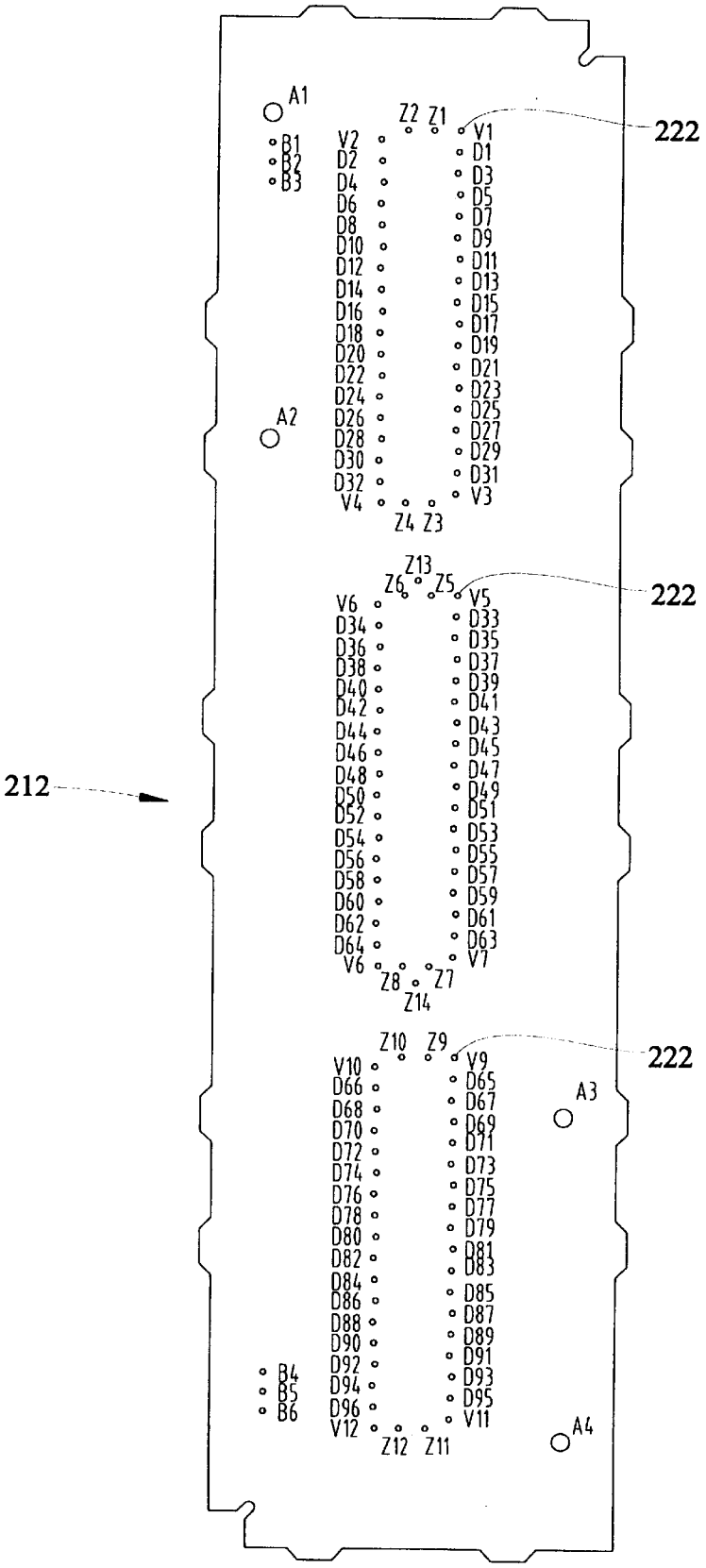
FIG. 11 is a top view of a nozzle plate for the printhead chip shown in FIG. 10.
Figure 12:
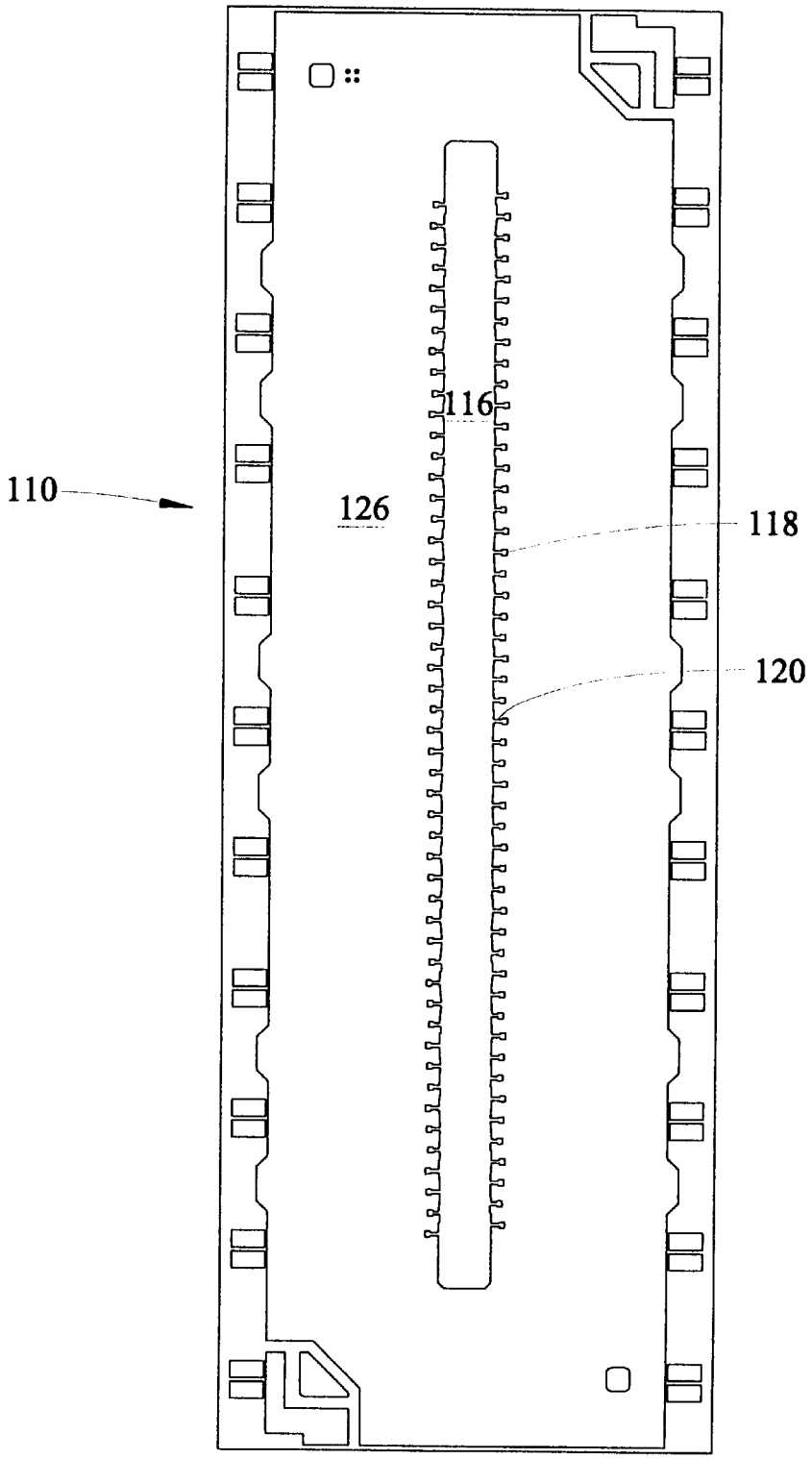
FIG. 12 is a top view of a mono-ink printhead chip according to another embodiment of the present invention.
Figure 13:
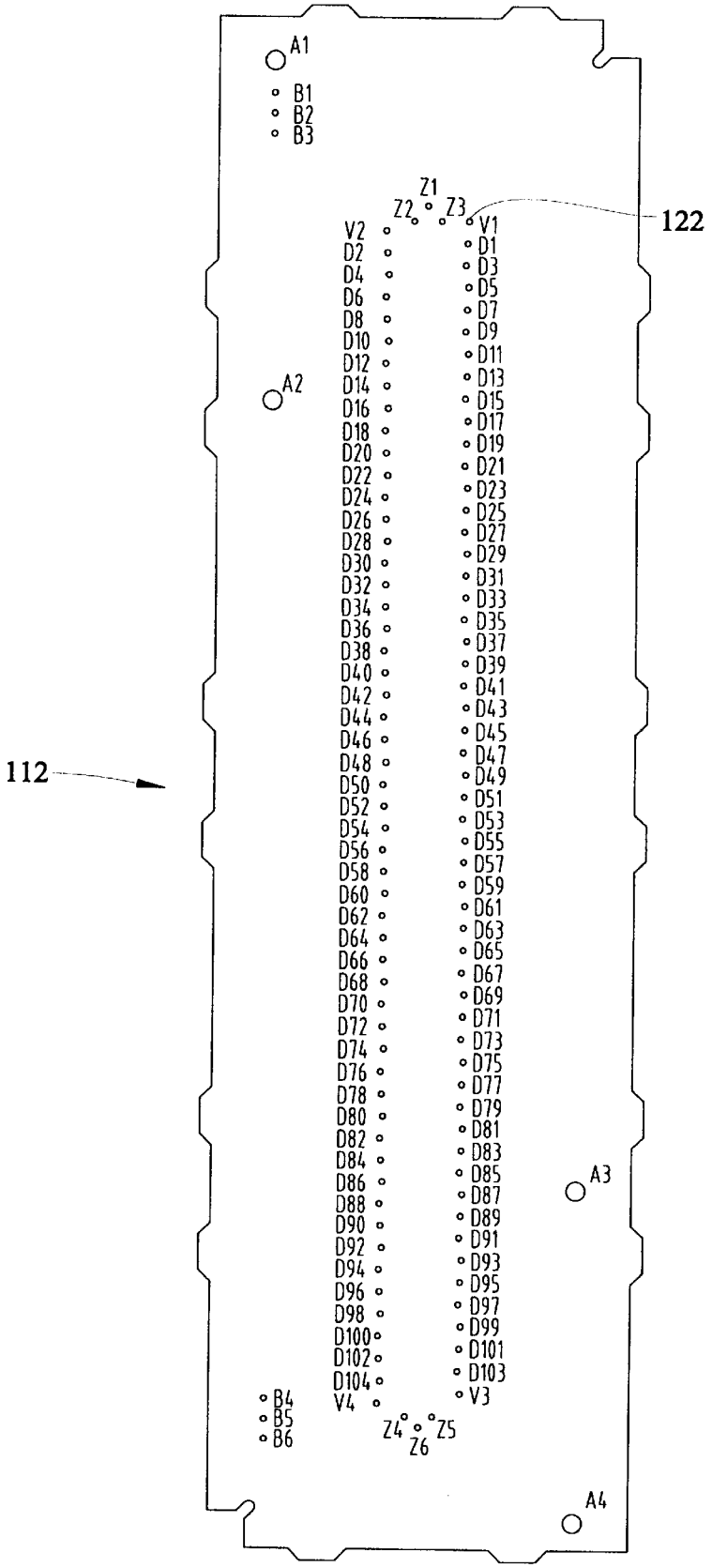
FIG. 13 is a top view of a nozzle plate corresponding to the printhead chip shown in FIG. 12.

As depicted in FIG. 9, in a further preferred embodiment, a printhead chip 11 can be formed with an array of heaters 24, as well as active elements 72 (such as semi-conductor devices capable of being formed in silicon), on the substrate base 14. Each heater 24 can be connected to an active circuit 72 comprising, for example, a field effect transistor (FET), arranged on opposite sides of the arrays of heaters. The heaters 24 and active elements 72 are preferably arranged on the surface 15 of the base 14 in longitudinally extending arrays, wherein one heater is associated with each nozzle 22. The chip 11 can also include data and address lines (not shown) connecting the active devices to the interconnects 70, which are typically located along the periphery of the chip 11.

Depending upon the physical orientation of the nozzle plate 12 relative to the print receiving medium 32, the vertical height or extent, the diameter of the nozzles 22 and the spacings between nozzles determine the vertical size of the print swath, and the horizontal width and spacing determine the packing density and firing rate of the printhead 10. As printing speeds and resolution density increase, larger and larger arrays of elements are required.

In the above structure, when printing occurs, simultaneously with the movement of the carrier 40 in the direction of the arrow 42 in FIG. 1, each heater 24 can be selectively driven with a power density in accordance with recording data so that the heater nucleates the ink and ejects a droplet from the nozzles 22 in the nozzle plate 12. The ink droplets impinge upon the surface of the print receiving medium 32, wherein they form the recording information on the print receiving medium. For example, a computer controlled switching program and apparatus can selectively connect an appropriate energy source to the pads 28 as required to "fire" the heaters 24 in a sequence necessary to meet the computer directed graphic requirements of the recording data.

Referring to FIGS. 10–13, in general, multi-color (color) printheads 210 separately and selectively eject inks of at least two different colors, typically through associated dedicated apertures 22. In contrast, mono-ink (mono) printheads 110 generally eject ink of a single color through each aperture 22. Typically, multi-color (color) ink (i.e., an ink capable of taking on a number of different colors—e.g., through the addition of dyes or pigments) is utilized with color printheads 210, while mono ink (i.e., ink specifically created for a particular color, such as black) is utilized with mono printheads 110.

According to the present invention, an improved printhead 10 preferably has a nozzle plate thickness (T) less than the nominal value (e.g., 62 microns) and a power density less than the nominal value (e.g., 2.159 $GW/m^2$). For example, a thickness (T) less than about 60 microns is preferred, with a thickness (T) of from about 35 microns to about 55 microns being more preferred. In particular, a thickness (T) of about 40 microns appears to be especially beneficial when using phosphate-containing multi-color inks, and a thickness (T) of about 51 microns appears to be especially beneficial when using non-phosphate multi-color inks, particularly when using heaters having a surface area (A) of about 1850 $microns^2$.

Preferably, a power density less than about 2 $GW/m^2$ and, more preferably, from about 0.7 $GW/m^2$ to about 1.5 $GW/m^2$, should be selectively applied when firing a transducer, such as a heater 24. In particular, using a power density of about 1 $GW/m^2$ appears to be especially beneficial for transducer life. In addition, using a non-phosphate multi-color ink instead of a phosphate-containing multi-color ink is also preferred, particularly when using low power densities (e.g., less than 2 $GW/m^2$) or when using thicker nozzle plates 12 (e.g., where T is greater that 40 microns).

The separation distance (S) between the nozzle plate 12 and the transducer is also preferably reduced to less than the nominal value (e.g., 28 microns). For example, a separation distance (S) of from about 8 microns to about 27 microns would be preferred. In particular, a separation distance (S) of about 24 microns appears to be especially beneficial.

As a further example, for a printhead 10 having a nominal power density of 1.424 $GW/m^2$, a preferred embodiment of the present invention might utilize, for example, power densities less than about 1.3 $GW/m^2$ and, more preferably, from about 0.7 $GW/m^2$ to about 1 $GW/m^2$. In particular, a power density of about 0.77 $GW/m^2$ appears to be especially beneficial for transducer life.

In yet another preferred embodiment of the present invention, an improved printhead 10 utilizing a mono ink or a non-phosphate multi-color ink with heaters 24, includes heaters having a surface area (A) greater than the nominal value (e.g., about 1,900 $microns^2$). For example, such printheads 10 tested with heaters 24 having surface areas (A) of about 2,900 $microns^2$ appear to have an increased life. In contrast, printheads 10 utilizing a phosphate-containing multi-color ink with heaters 24 preferably use heaters having surface areas (A) less than the nominal value (e.g., about 2,800 $microns^2$). For example, such printheads 10 tested with heaters 24 having surface areas (A) of about 1,850 $microns^2$ appear to have an increased life.

In addition, according to yet a further preferred embodiment, using a mono ink instead of a multi-color ink also appears to increase transducer life. This embodiment proves especially beneficial, for example, when utilized with printheads 10 using higher power densities (e.g., greater than 1 $GW/m^2$) or with printheads 10 having shorter nozzle plate separation distances (S) (e.g., less than 28 microns). Similarly, it appears that printheads 10 with shorter nozzle plate separation distances (S) (e.g., less than 28 microns) are more beneficial when utilized with mono inks or with heaters having smaller heater areas (A) (e.g., less than about 2,800 $microns^2$).

The following examples demonstrate various embodiments of the invention, and have been provided for purposes of illustration and description. The examples are not intended to be exhaustive or to limit the invention to the precise forms disclosed.

EXAMPLE 1

Color printheads 210 and mono printheads 110, similar to those shown in FIG. 10–13, were manufactured according to various embodiments of the present invention. Although utilizing heaters with different areas (A) (color=1,849 $microns^2$; mono=2,888 $microns^2$), the manufactured printheads had a comparable number of heaters. The printheads were then tested with different inks and power densities, with the results being shown in Table 1, wherein "wafer batch" merely refers to the production batch in which the wafer for the respective printhead was manufactured. In this and the remaining examples, barrier height (H) is given prior to attachment of the respective nozzle plate 12. Typically, once the respective plate 12 has been attached, the nozzle plate separation distance (S) is about 2 microns less than the barrier height (H) prior to attachment of the nozzle plate.

TABLE 1

| Printhead | Wafer Batch | (A) Heater Area ($\mu m^2$) | Power Density ($GW/m^2$) | (T) Nozzle Plate Thickness ($\mu m$) | (H) Barrier Heights[1] ($\mu m$) | Ink[2] | Average Observed MTTF[3] (M) |
|---|---|---|---|---|---|---|---|
| 1-1 | 2 | 1,849 | 1 | 40 | 26 | Color - NP | 224 [125, 401] |
| 1-2 | 2 | 2,888 | 0.77 | 51 | 30 | Color - NP (D) | 328 [247, 434] |
| 1-3 | 2 | 2,888 | 1.8 | 40 | 26 | Color - NP | 17 [15, 19] |
| 1-4 | 1 | 2,888 | 1.8 | 40 | 30 | Color - NP (D) | 81 [74, 88] |
| 1-5 | 1 | 2,888 | 1.8 | 51 | 26 | Mono | 16 [13, 20] |
| 1-6 | 2 | 2,888 | 1.8 | 51 | 30 | Color - P | 15 [12, 20] |
| 1-7 | 1 | 1,849 | 1 | 40 | 30 | Color - NP (D) | 50 [27, 95] |
| 1-8 | 2 | 1,849 | 1.9 | 40 | 30 | Color - P | 30 [20, 46] |
| 1-9 | 1 | 1,849 | 1.9 | 40 | 26 | Mono | 206 [140, 301] |
| 1-10 | 1 | 2,888 | 0.77 | 51 | 26 | Color - NP | 335 [284, 396] |
| 1-11 | 2 | 2,888 | 0.77 | 40 | 30 | Mono | 259 [190, 354] |
| 1-12 | 1 | 2,888 | 0.77 | 40 | 26 | Color - P | 142 [92, 221] |
| 1-13 | 1 | 1,849 | 1 | 51 | 30 | Mono | 75 [50, 113] |
| 1-14 | 1 | 2,888 | 1.3 | 40 | 30 | Color - NP | 125 [90, 175] |
| 1-15 | 2 | 2,888 | 1.3 | 40 | 26 | Color - NP (D) | 25 [22, 30] |
| 1-16 | 2 | 1,849 | 1 | 51 | 26 | Color - P | 173 [124, 239] |

[1]Prior to attachment of nozzle plate
[2]Color - NP (D) dyeless non-phosphate multi-color ink
Color - NP = non-phosphate multi-color ink
Color - P = phosphate-containing multi-color ink
Mono = monocolor ink.
[3]MTTFs (median time to failures) represent the number of fires before failure, in millions (M), and the bracketed values represent the 95% confidence intervals The median time to failure (MTTF) is a common measure of the average life of a heater. Generally, the higher the MTTF, the more reliable the printhead. The MTTFs discussed herein are given in terms of numbers of fires before failure (in millions).

A printhead was considered to have failed after the first heater failure. In this experiment, failure was considered to have occurred when the resistance of at least one heater increased by approximately 1.5 times its nominal value. All failures were confirmed optically.

After completion of this experiment, a regression equation was produced to further model and test the present invention. Table 1A shows a comparison of the model predictions to the observed values for the printheads tested in Table 1. The model was also tested by running up to three printheads at each set of conditions. The observed MTTF and the model predictions for these printheads are shown in Table 2.

TABLE 1A

| Printhead | Average Observed MTTF+ (M) | Predicted MTTF+(M) |
|---|---|---|
| 1-1 | 224 [125, 401] | 242 [162, 362] |
| 1-2 | 328 [247, 434] | 236 [131, 424] |
| 1-3 | 17 [15, 19] | 14 [8, 22] |
| 1-4 | 81 [74, 88] | 81 [38, 171] |
| 1-5 | 16 [13, 20] | 19 [13, 29] |
| 1-6 | 15 [12, 20] | 15 [8, 27] |
| 1-7 | 50 [27, 95] | 47 [31, 72] |
| 1-8 | 30 [20, 46] | 29 [18, 46] |
| 1-9 | 206 [140, 301] | 177 [120, 263] |
| 1-10 | 335 [284, 396] | 369 [203, 671] |
| 1-11 | 259 [190, 354] | 271 [181, 405] |
| 1-12 | 142 [92, 221] | 123 [78, 195] |
| 1-13 | 75 [50, 113] | 86 [53, 142] |
| 1-14 | 125 [90, 175] | 116 [56, 239] |
| 1-15 | 25 [22, 30] | 32 [20, 53] |
| 1-16 | 173 [124, 239] | 130 [82, 206] |

TABLE 2

| Printhead | Wafer Batch | (A) Heater Area ($\mu m^2$) | Power Density ($GW/m^2$) | (T) Nozzle Plate Thickness ($\mu m$) | (H) Barrier Height ($\mu m$) | Ink | No. of Obs. | Average Observed MTTF (M) | Predicted* Range (M) |
|---|---|---|---|---|---|---|---|---|---|
| 2-1 | 2 | 2,888 | 1.424 | 62 | hi | Mono | 3 | 41 | 25–60 |
| 2-2 | 2 | 2,888 | 1.424 | 40 | low | Mono | 3 | 73 | 68–207 |
| 2-3 | 2 | 2,888 | 0.77 | 40 | low | Mono | 3 | 189 | 203–629 |
| 2-4 | 2 | 1,849 | 2.159 | 40 | low | Color - NP | 2 | 50 | 10–28 |
| 2-5 | 2 | 1,849 | 0.99 | 40 | low | Color - NP | 2 | 221 | 162–362 |
| 2-6 | 1 | 1,849 | 0.99 | 40 | low | Color - P | 1 | 120 | 103–308 |
| 2-7 | 2 | 1,849 | 0.99 | 40 | low | Color - P | 1 | 214 | 133–410 |
| 2-8 | 2 | 1,849 | 2.159 | 40 | low | Color - P | 2 | 28 | 16–36 |
| 2-9 | 1 | 1,849 | 2.159 | 62 | hi | Color - NP | 2 | 6.7 | 10–23 |
| 2-10 | 1 | 1,849 | 2.159 | 62 | hi | Color - P | 2 | 4.7 | 6–15 |

*range is 95% confidence interval for MTTF.

The discrepancies between the predicted and observed failure times may be due to the use of a different batch to test the model. However, some batch to batch variation is unavoidable. In all cases, the 95% confidence bounds of the model predictions are expressed as a long term average of a large sample. With only a few printheads tested at each condition, perfect agreement between model and observation is not expected, as can be understood by one of ordinary skill in the art. Still, an empirical model appears to be an effective predictor of printhead failure, and was used to develop the subsequent experiments.

EXAMPLE 2

The color printheads used for these experiments have a nominal barrier height (H) of about 30 microns (prior to attachment of the nozzle plate) and a nominal nozzle plate thickness (T) of about 62 microns, and are fired using a nominal power density of about 2.159 GW/m$^2$. Generally, once attached, the nozzle plate separation distance (S) is about 2 microns less than the barrier height (H) prior to attachment. As shown in Table 3, when using a phosphate-containing color ink, such as a dye-based magenta ink, such a printhead has a predicted life of about 9.7M, where M signifies the number of fires in millions, with 95% confidence bounds of [6M, 15M]. Reducing the nozzle plate thickness (T) to about 40 microns increases the predicted MTTF from about 9.7M to about 30M [19, 48], thereby tripling the expected life of the printhead. Meanwhile, also reducing the barrier height (H) to about 26 microns (prior to attachment) increases the predicted MTTF of the printhead to about 31M [21, 47].

example, decreasing the power density to 1 GW/m$^2$ and reducing the nozzle plate thickness (T) and barrier height (H) (prior to attachment) to 40 microns and 26 microns respectively, increases the predicted MTTF of the printhead to about 234M [133, 410], about six times greater than the predicted life of a nominal color printhead operated under nominal conditions.

Figure 14:
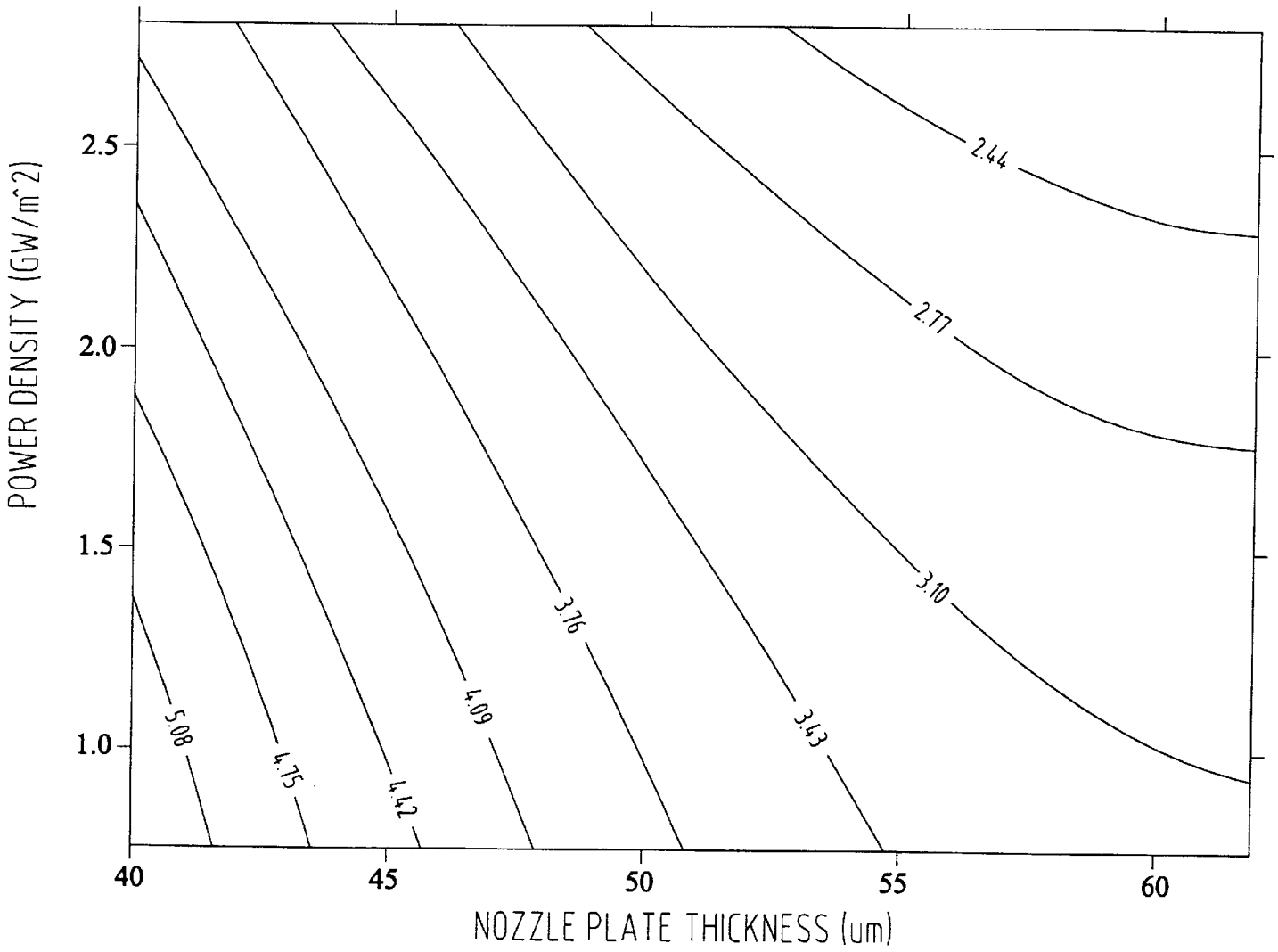
FIG. 14 is a contour plot of the log of life as a function of nozzle plate thickness and power density for a multi-color printhead using a phosphate containing color ink with a barrier height of 30 microns (prior to attachment of the nozzle plate)

FIG. 14 is a contour plot of the natural logarithm of life of a heater as a function of nozzle plate thickness (T) and power density for the color ink jet printhead using a dye-based, phosphate-containing magenta ink. For this plot, the barrier was set to the nominal height (H) of 30 microns (prior to attachment). The curved contours of the plot indicate that power density and nozzle plate thickness (T) interact.

From the plot, it can thus be understood that lower power densities and thinner nozzle plates produce the longest life. The behavior is essentially the same for a barrier height (H) of 26 microns (prior to attachment). Therefore, the MTTF of a printhead can be greatly improved by decreasing the power density, the nozzle plate thickness (T) and barrier height (H).

Figure 15:
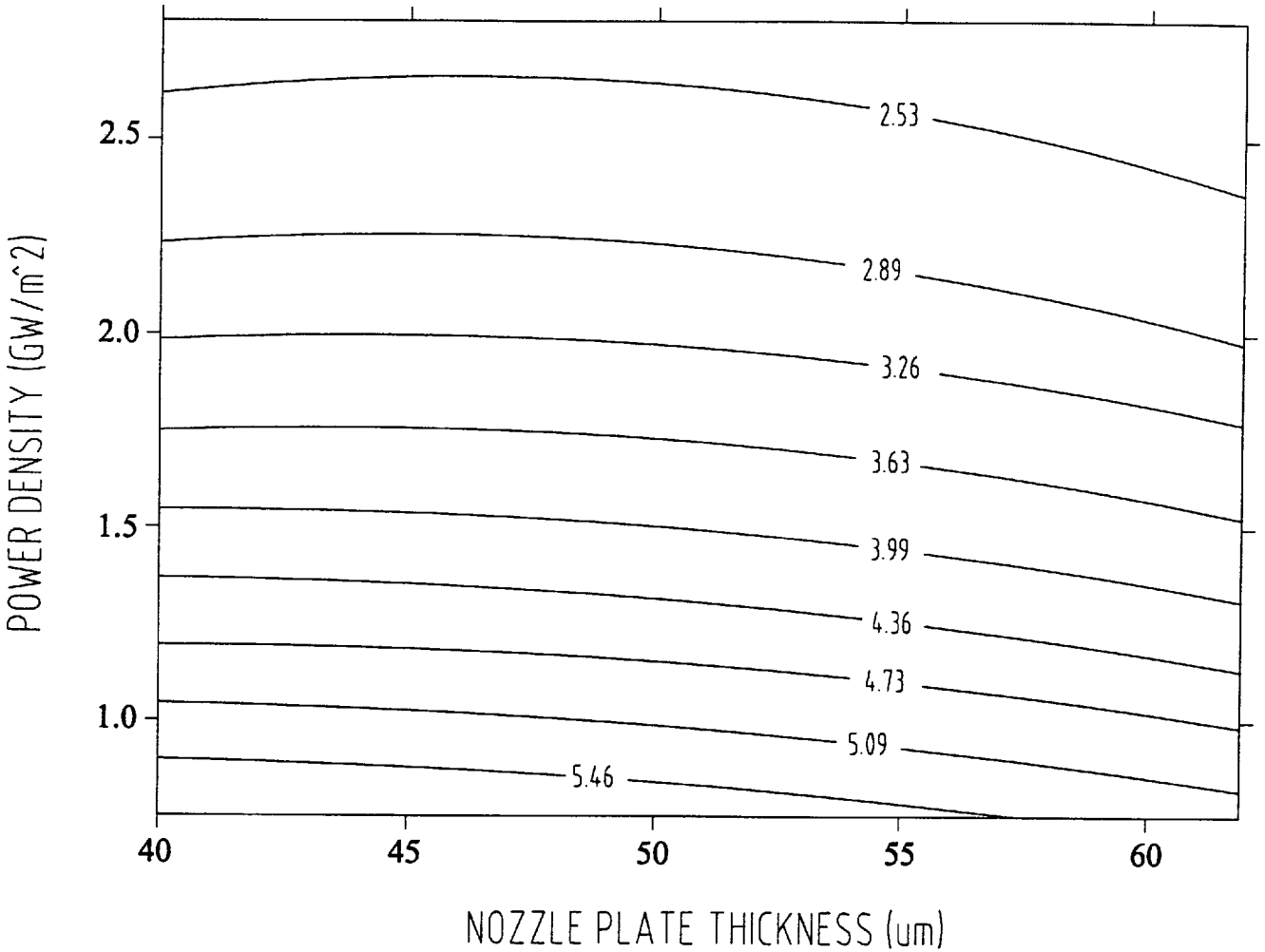
FIG. 15 is a contour plot of the log of life as a function of nozzle plate thickness and power density for a multi-color printhead using a color ink containing no phosphates with a barrier height of 30 microns (prior to attachment of the nozzle plate)
Figure 16:
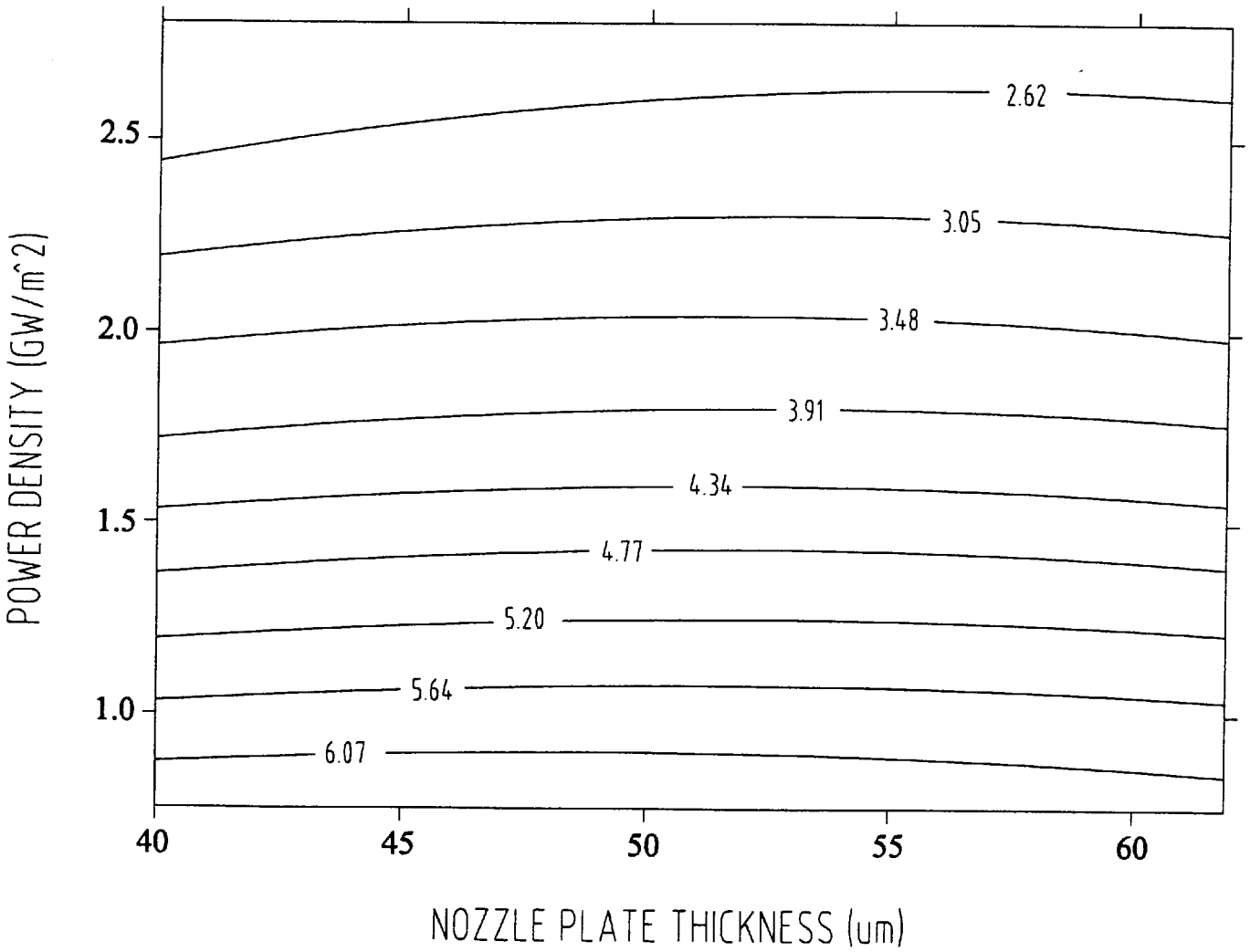
FIG. 16 is a contour plot of the log of life as a function of nozzle plate thickness and power density for a multi-color printhead using a color ink containing no phosphates with a barrier height of 26 microns (prior to attachment of the nozzle plate)

As shown in FIGS. 15–16, when using a color ink containing no phosphates, such as a dye-based, non-phosphate magenta ink, the interaction between power and nozzle plate thickness (T) appears to be weaker. For example, the MTTF of a printhead using a power density of 2.159 GW/m$^2$ and non-phosphate color ink, and having a

TABLE 3

| Printhead | Wafer Batch | (A) Heater Area ($\mu m^2$) | Power Density (GW/m$^2$) | (T) Nozzle Plate Thickness ($\mu m$) | (H) Barrier Heights[1] ($\mu m$) | Ink | Predicted MTTF (M) | Predicted+ Range (M) |
|---|---|---|---|---|---|---|---|---|
| 3-1 | 1 | 1,849 | 2.159* | 62* | 30* | Color - P | 9.7 | 6–15 |
| 3-2 | 1 | 1,849 | 2.159* | 40 | 30* | Color - P | 30 | 19–48 |
| 3-3 | 1 | 1,849 | 2.159* | 40 | 26 | Color - P | 31 | 21–47 |
| 3-4 | 1 | 1,849 | 2.159* | 62* | 30* | Color - NP | 15 | 9.7–48 |
| 3-5 | 1 | 1,849 | 2.159* | 40 | 26 | Color - NP | 22 | 13–36 |
| 3-6 | 1 | 1,849 | 2.159* | 55 | 26 | Color - NP | 26 | 17–36 |
| 3-7 | 1 | 1,849 | 1.5 | 62* | 30* | Color - P | 18 | 10–30 |
| 3-8 | 1 | 1,849 | 1.5 | 40 | 26 | Color - P | 82 | 54–125 |
| 3-9 | 1 | 1,849 | 1.5 | 62* | 30* | Color - NP | 39 | 26–60 |
| 3-10 | 1 | 1,849 | 1.5 | 51 | 26 | Color - NP | 95 | 62–144 |
| 3-11 | 1 | 1,849 | 1 | 62* | 30* | Color - P | 37 | 19–74 |
| 3-12 | 1 | 1,849 | 1 | 40 | 26 | Color - P | 234 | 133–410 |
| 3-13 | 1 | 1,849 | 1 | 62* | 30* | Color - NP | 110 | 70–174 |
| 3-14 | 1 | 1,849 | 1 | 51 | 26 | Color - NP | 348 | 224–537 |

[1]Prior to attachment of nozzle plate
*nominal dimension
+range is 95% confidence interval for MTTF As can be understood from Table 3, when a lower power density is used with the nominal color printheads, the life of the printheads also increase. For example, when a power density of about 1.5 GW/m$^2$ is applied to the nominal color printhead, the predicted life of the nominal printhead increases to about 18M [10, 30]. Moreover, applying a power density of about 1 GW/m$^2$ increases the predicted life of the nominal color printhead 210 to about 37M [19, 74].

Accordingly, it appears that reducing the nozzle plate thickness (T) and barrier height (H) can produce an improvement in printhead life. Moreover, reducing the power density also increases printhead life. However, as shown below, applying a reduced power density in combination with the aforementioned reduced dimensions leads to an unexpectedly large increase in printhead life. For nozzle plate thickness (T) and barrier height (H) (prior to attachment) of 40 and 26 microns, respectively, is 22M [13, 36], which is shorter than that seen with a phosphate-containing color ink. A shorter life using a non-phosphate color ink was unexpected, since previous tests had shown that the MTTFs of printheads using a non-phosphate color ink should have been at least as long as the MTTFs of printheads using a phosphate-containing color ink.

For lower power densities, the life of a printhead using a non-phosphate color ink appears to be slightly longer for a nozzle plate thickness (T) of about 50 microns, than for the minimum tested thickness (T) of 40 microns. For example, by increasing the nozzle plate thickness (T) to 55 microns, the MTTF can be slightly improved to 26 M [17, 36]. Thus, the optimum value for the nozzle plate thickness (T) may not always be the minimum.

Using a power density of 1 $GW/m^2$ with the minimum tested values for nozzle plate thickness (T) and barrier height (H), the predicted MTTF when using a non-phosphate color ink rises to 309 M [202, 471]. However, an additional improvement can be obtained by increasing nozzle plate thickness (T) from 40 to 51 microns. In this case, the predicted MTTF is 348 M [224, 537]. Accordingly, at lower power densities, non-phosphate color ink appears to give a longer MTTF than phosphate-containing color ink. Moreover, it appears that increasing the phosphate content of an ink to be used with a printhead will adversely affect the reliability of such a printhead.

Accordingly, the interactions between the variables must be known in order to choose the optimum operating conditions. For example, the best nozzle plate thickness (T) tested with a phosphate-containing color ink is 40 microns, but for a non-phosphate color ink, a higher MTTF was achieved with a nozzle plate thickness (T) of about 50 microns, depending on power level, etc. Moreover, although the longest observed life was attained by reducing the power density to 1 $GW/m^2$, such a power density can be unacceptable with conventional printheads due to diminished print quality. However, the model can be used to reach a compromise by predicting the MTTF for a desired power density.

The trends shown by this model and the tested data should continue outside the tested ranges. For example, the generally unexpectedly large increase in predicted printhead life should continue for printheads with nozzle plate thicknesses (T), barrier heights (H), and power densities below the minimum tested values of 40 microns, 26 microns (prior to attachment), and 0.77 $GW/m^2$ respectively. Accordingly, these arbitrarily chosen test values should not be viewed as limits with respect to the present invention.

However, under the current state of the art, the minimum practical values for the nozzle plate thickness (T), barrier height (H), and power density are approximately 35 microns, 10 microns (prior to attachment), and 0.7 $GW/m^2$ respectively. As can be understood, these practical values reflect the current state of the art and not the present invention. For example, although a power density of about 0.7 $GW/m^2$ is currently needed to nucleate ink above a particular heater, this practical limitation in the art could be overcome with new technology that might enable the use of thinner protective layers over the heater, thereby requiring the application of less power to the heater.

EXAMPLE 3

Figure 17:
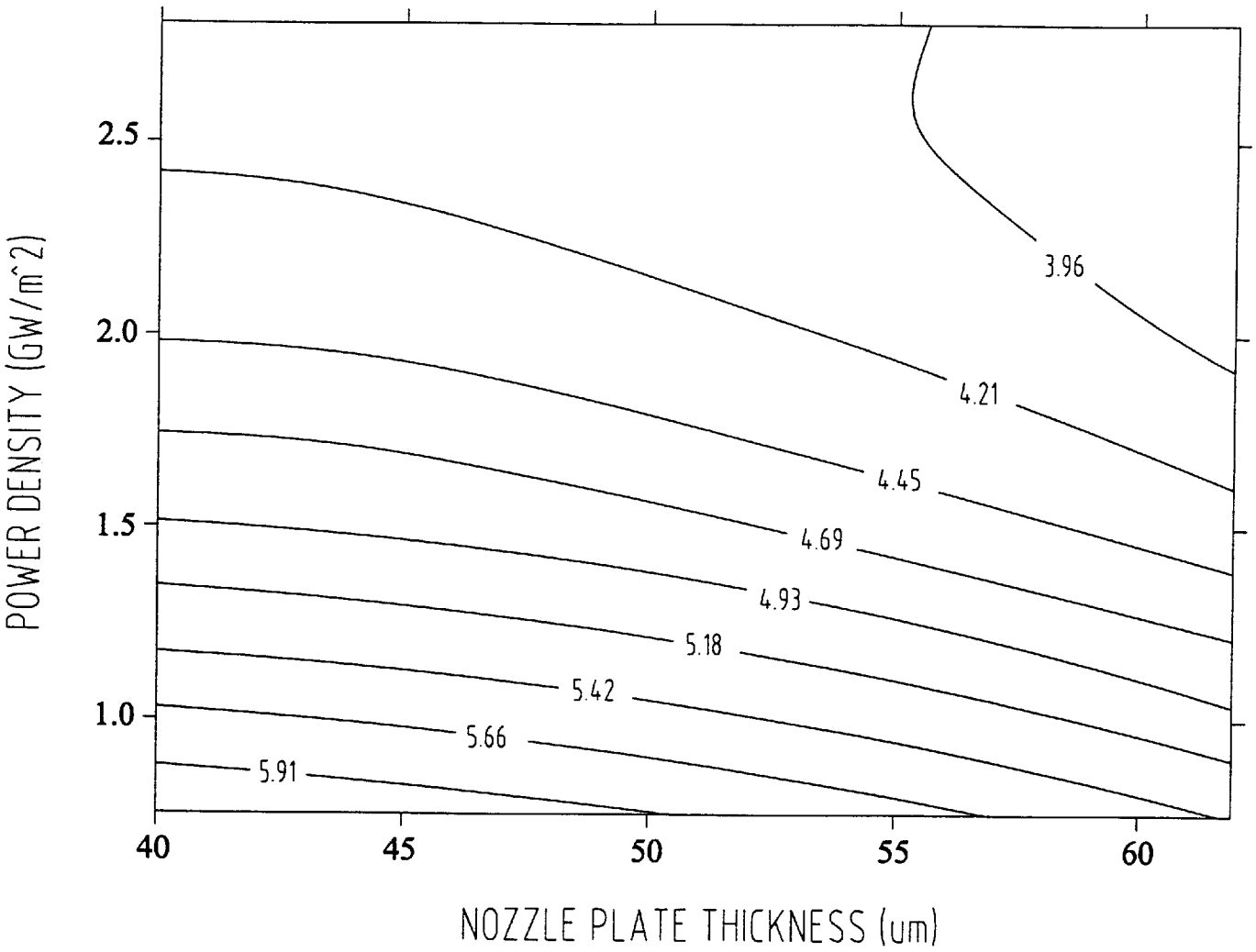
FIG. 17 is a contour plot of the log of life as a function of nozzle plate thickness and power density for a mono-ink printhead using a mono ink with a barrier height of 27 microns (prior to attachment of the nozzle plate).

Table 4 gives a summary of model predictions for a mono printhead under various conditions. The behavior of the mono printhead was much the same as the color printhead. For example, from FIG. 17, it can be understood that lowering the power density and thinning the nozzle plate can improve heater life.

TABLE 4

| Print-head | Wafer Batch | (A) Heater Area ($\mu m^2$) | Power Density ($GW/m^2$) | (T) Nozzle Plate Thickness ($\mu m$) | (H) Barrier Heights[1] ($\mu m$) | Ink | Predicted MTTF (M) | Predicted+ Range (M) |
|---|---|---|---|---|---|---|---|---|
| 4-1 | 1 | 2,888 | 1.424* | 62* | 30* | Mono | 51 | 33–79 |
| 4-2 | 1 | 2,888 | 1.424* | 40 | 30* | Mono | 153 | 96–245 |
| 4-3 | 1 | 2,888 | 1.424* | 40 | 27 | Mono | 156 | 88–275 |
| 4-4 | 1 | 2,888 | 0.77 | 62* | 30* | Mono | 107 | 70–163 |
| 4-5 | I | 2,888 | 0.77 | 40 | 30* | Mono | 355 | 234–539 |
| 4-6 | 1 | 2,888 | 0.77 | 40 | 27 | Mono | 468 | 266–823 |

[1]Prior to attachment of nozzle plate
*nominal dimension
+range is 95% confidence interval for MTTF The nominal power density for the mono printheads was about 1.424 $GW/m^2$. With nominal nozzle plate thicknesses (T) and barrier heights (H) (prior to attachment) of 62 microns and 30 microns, respectively, the predicted MTTF for the nominal mono printheads using a mono ink, such as a dye-based black ink, was 51 M [33, 79]. At nominal power with mono ink, the optimum tested values for the barrier height (H) (prior to attachment) and the nozzle plate thickness (T) were 27 and 40 microns respectively. Under these circumstances, the MTTF of the mono printhead was predicted to be about 156 M [88, 275], which is three times higher than the nominal configuration. If the power density is further reduced to 0.77 $GW/m^2$, (with all other variables constant) the predicted MTTF goes up to 468 M [266, 823].

EXAMPLE 4

Table 5 gives a summary of predicted printhead life with two different heater areas under different conditions. From past experiments, it was believed that printhead life decreased as heater area (A) was reduced. This belief is only partially validated by the present invention.

TABLE 5

| Printhead | Wafer Batch | (A) Heater Area ($\mu m^2$) | Power Density ($GW/m^2$) | (T) Nozzle Plate Thickness ($\mu m$) | (H) Barrier Heights[1] ($\mu m$) | Ink | Predicted MTTF (M) | Predicted* Range (M) |
|---|---|---|---|---|---|---|---|---|
| 5-1 | 1 | 1,849 | 2 | 62 | 30 | Mono | 23 | 13–41 |
| 5-2 | 1 | 2,888 | 2 | 62 | 30 | Mono | 38 | 21–69 |
| 5-3 | 1 | 1,849 | 2 | 62 | 30 | Color - NP | 18 | 12–27 |
| 5-4 | 1 | 2,888 | 2 | 62 | 30 | Color - NP | 24 | 13–42 |
| 5-5 | 1 | 1,849 | 2 | 62 | 30 | Color - P | 11 | 7–17 |
| 5-6 | 1 | 2,888 | 2 | 62 | 30 | Color - P | 9 | 5–15 |
| 5-7 | 1 | 1,849 | 2 | 40 | 30 | Mono | 75 | 49–116 |
| 5-8 | 1 | 2,888 | 2 | 40 | 30 | Mono | 104 | 54–204 |
| 5-9 | 1 | 1,849 | 2 | 40 | 30 | Color - NP | 26 | 12–53 |
| 5-10 | 1 | 2,888 | 2 | 40 | 30 | Color - NP | 28 | 14–56 |
| 5-11 | 1 | 1,849 | 2 | 40 | 30 | Color - P | 35 | 22–55 |
| 5-12 | 1 | 2,888 | 2 | 40 | 30 | Color - P | 23 | 10–51 |
| 5-13 | 1 | 1,849 | 2 | 40 | 30 | Mono | 149 | 86–260 |
| 5-14 | 1 | 2,888 | 2 | 40 | 30 | Mono | 251 | 167–378 |
| 5-15 | 1 | 1,849 | 1 | 40 | 30 | Color - NP | 186 | 90–384 |
| 5-16 | 1 | 2,888 | 1 | 40 | 30 | Color - NP | 249 | 115–535 |
| 5-17 | 1 | 1,849 | 1 | 40 | 30 | Color - P | 140 | 188–285 |
| 5-18 | 1 | 2,888 | 1 | 40 | 30 | Color - P | 113 | 66–196 |
| 5-19 | 1 | 1,849 | 1 | 40 | 26 | Mono | 490 | 254–945 |
| 5-20 | 1 | 2,888 | 1 | 40 | 27 | Mono | 303 | 178–513 |
| 5-21 | 1 | 1,849 | 1 | 40 | 26 | Color - NP | 309 | 202–471 |
| 5-22 | 1 | 2,888 | 1 | 40 | 27 | Color - NP | 151 | 93–244 |
| 5-23 | 1 | 1,849 | 1 | 40 | 26 | Color - P | 234 | 133–410 |
| 5-24 | 1 | 2,888 | 1 | 40 | 27 | Color - P | 68 | 44–104 |

[1]Prior to attachment of nozzle plate
*predictions with 95% confidence bounds

While printheads with smaller heater areas (A) may exhibit lower reliability than those with larger heater areas (A) (depending on the power density, ink, and nozzle plate and barrier dimensions), it appears to be evident from Table 5 that, when using phosphate-containing color inks, printheads featuring smaller heater areas (A) tend to last longer than those featuring larger heater areas (A). On the other hand, the presence of mono ink causes printheads featuring smaller heater areas (A) to fail earlier, except under conditions of power density=1 $GW/m^2$, nozzle plate thickness (T)=40 microns, and barrier height (H) (prior to attachment)=26 microns (or 27 microns for mono). Therefore, Table 5 shows that heater area (A) can also play a role in reliability, depending on power density, nozzle plate thickness (T), barrier height (H), and ink type.

While the invention directly applies to the printheads tested, its implications are broader. For example, reducing the power density while simultaneously reducing nozzle plate thickness (T) and barrier height (H) should greatly improve printhead reliability. Moreover, at low power densities and with reduced chamber dimensions, printheads 10 featuring smaller heater areas (A) tend to last longer than those featuring larger heater areas (A). In addition, although these trends should be observed for any ink type, the choice of a non-phosphate containing color ink, can further improve reliability at lower powers.

Under nominal power density, an improvement in MTTF can be obtained by lowering the nozzle plate thickness (T) and barrier height (H). Reducing the power density while keeping nozzle plate thickness (T) and barrier height (H) nominal also increases the MTTF. By reducing all three factors, a very large improvement in life can be achieved. Moreover, choice of heater area (A) depends on how the previous three factors are set, as does the choice of ink. In a preferred embodiment, the optimum conditions would be derived from the empirical model, which takes interactions between these variables into account.

The foregoing description of the preferred embodiments of the present invention has been presented for purposes of illustration and description. It is not intended to be exhaustive or to limit the invention to the precise form disclosed, and modifications and variations are possible in light of the above teachings. For example, although a number of materials and shapes have been described or shown for use in the preferred embodiments of the present invention, it is to be understood that other materials and shapes could be used as alternatives to those described or shown without departing from the scope of the invention.

In particular, although the chamber 18 has been shown as having a generally square-shaped conformation, it could have a variety of shapes such as, for example, any other generally polygonal, circular, or similar shaped conformation. Similarly, although the barrier 27 is depicted in the several figures as being formed from a thick film layer 26 extending above the heater 24 a generally uniform height (H), the barrier need not necessarily be formed from the thick film or any other layer, and the height (H) could be variable. Further examples of modifications and variations within the scope of the present invention may include using other varieties of transducers, such as piezo-electric elements for example, providing the chamber 18 and transducer within a printhead 10 without using a chip 11, providing the ink to the chamber 18 according to alternative arrangements not shown by the various figures, such as by using an edge-feed arrangement, eliminating the conduit laterals 20, and/or eliminating the channel 16 altogether, and utilizing a configuration other than a configuration known in the art as a roof shooter, such as side shooter configuration for example.

Similarly, the various figures have been provided in order to illustrate various features of the present invention. They should not be viewed as restrictive in nature. For example, the various figures are not always depicted in scale nor should they be so interpreted.

Thus, it should be understood that the embodiments were chosen and described in order to best illustrate the principals of the invention and its practical application. This illustration was provided to thereby enable one of ordinary skill in the art to best utilize the invention in various embodiments and with various modifications as are suited for the particular use contemplated. Accordingly, it is intended that the scope of the invention be defined by the claims appended hereto.

I claim:

1. An inkjet printhead comprising:

a) a transducer, at least a portion of which is arranged within a chamber; and b) a plate provided with at least one aperture capable of cooperating with the chamber to allow ink to be ejected from the chamber, wherein the plate has a thickness of less than 62 microns and the transducer is capable of being selectively energized with a power density less than 2.159 GW/m$^2$ to cause droplets of ink to be ejected from the chamber.

2. The inkjet printhead of claim 1, wherein the plate is separated from the transducer by a distance of less than 28 microns.

3. The inkjet printhead of claim 2, wherein said plate is separated from the transducer by a distance of about 8 to about 27 microns.

4. The inkjet printhead of claim 3, wherein said plate is separated from the transducer by a distance of about 24 microns.

5. The inkjet printhead of claim 3, wherein said transducer comprises a heater having a heater area of less than about 2800 microns$^2$.

6. The inkjet printhead of claim 3, further comprising a mono ink.

7. The inkjet printhead of claim 1, wherein said plate thickness is less than about 60 microns.

8. The inkjet printhead of claim 7, wherein said plate thickness is about 35 to about 55 microns.

9. The inkjet printhead of claim 8, wherein said plate thickness is about 40 microns.

10. The inkjet printhead of claim 8, further comprising a non-phosphate multi-color ink and wherein said plate thickness is about 51 microns.

11. The inkjet printhead of claim 1, wherein said transducer is capable of being selectively energized with a power density less than about 2 GW/m$^2$ to cause droplets of ink to be ejected from the chamber.

12. The inkjet printhead of claim 11, wherein said inkjet printhead is a mono ink inkjet printhead and the transducer is capable of being selectively energized with a power density less than about 1.3 GW/m$^2$ to cause droplets of ink to be ejected from the chamber.

13. The inkjet printhead of claim 12, wherein said transducer is capable of being selectively energized with a power density of about 0.7 to about 1 GW/m$^2$ to cause droplets of ink to be ejected from the chamber.

14. The inkjet printhead of claim 13, wherein said transducer is capable of being selectively energized with a power density of about 0.77 GW/m$^2$ to cause droplets of ink to be ejected from the chamber.

15. The inkjet printhead of claim 11, wherein said inkjet printhead is a multi-color inkjet printhead and the transducer is capable of being selectively energized with a power density of about 0.7 to about 1.5 GW/m$^2$ to cause droplets of ink to be ejected from the chamber.

16. The inkjet printhead of claim 15, wherein said transducer is capable of being selectively energized with a power density of about 1 GW/m$^2$ to cause droplets of ink to be ejected from the chamber.

17. The inkjet printhead of claim 1, further comprising a mono ink.

18. The inkjet printhead of claim 17, wherein said transducer is capable of being selectively energized with a power density greater than 1 GW/m$^2$ to cause droplets of ink to be ejected from the chamber.

19. The inkjet printhead of claim 17, wherein the plate is separated from the transducer by a distance of less than 28 microns.

20. The inkjet printhead of claim 17, wherein said transducer comprises a heater having a heater area greater than about 1900 microns$^2$.

21. The inkjet printhead of claim 20, wherein said heater has a heater area of about 2,900 microns$^2$.

22. The inkjet printhead of claim 1, further comprising a multi-color non-phosphate ink.

23. The inkjet printhead of claim 22, wherein said transducer is capable of being selectively energized with a power density less than 2 GW/m$^2$ to cause droplets of ink to be ejected from the chamber.

24. The inkjet printhead of claim 22, wherein said plate thickness is greater than 40 microns.

25. The inkjet printhead of claim 22, wherein said transducer comprises a heater having a heater area greater than about 1900 microns$^2$.

26. The inkjet printhead of claim 25, wherein said heater has a heater area of about 2,900 microns$^2$.

27. The inkjet printhead of claim 1, further comprising an ink containing phosphates and wherein the transducer comprises a heater having a heater area less than about 2800 microns$^2$.

28. The inkjet printhead of claim 27, wherein said heater has a heater area less than about 1850 microns$^2$.

29. An inkjet printhead comprising:

a) a plurality of transducers and a plurality of chambers, at least a portion of each transducer being arranged within a respective chamber; and b) a plate provided with a plurality of apertures, each aperture being capable of cooperating with a respective chamber to allow ink to be ejected from the respective chamber, wherein the plate has a thickness of less than 62 microns and each transducer is capable of being selectively energized with a power density less than 2.159 GW/m$^2$ to cause droplets of ink to be ejected from the respective chamber.

30. The inkjet printhead of claim 29, wherein the plate is separated from the transducer by a distance of less than 28 microns.

31. An inkjet printer comprising:

a) a printhead comprising:

ii) a transducer, at least a portion of which is arranged within a chamber; and ii) a plate provided with at least one aperture capable of cooperating with the chamber to allow ink to be ejected from the chamber, the plate having a thickness of less than 62 microns; and b) a power source capable of selectively energizing the transducer with a power density less than 2.159 GW/m$^2$ to cause droplets of the ink to be ejected from the chamber.

32. The inkjet printer of claim 31, wherein the plate is separated from the transducer by a distance of less than 28 microns.

33. A method for increasing the life of an inkjet printhead which includes a transducer to heat an ink droplet, comprising the steps of:

a) arranging at least a portion of the inkjet printhead transducer within a chamber;

b) providing a plate having at least one aperture capable of cooperating with the chamber to allow ink to be ejected from the chamber, the plate having a thickness of less than 62 microns; and c) selectively energizing the transducer with a power density less than 2.159 $GW/m^2$ to cause droplets of the ink to be ejected from the chamber.

34. The method of claim 33, further comprising the step of separating the plate from the transducer by a distance of less than 28 microns.

* * * * *